US009272539B2

(12) United States Patent
Yasu et al.

(10) Patent No.: US 9,272,539 B2
(45) Date of Patent: Mar. 1, 2016

(54) IMAGE FORMING APPARATUS USING A PRE-PROCESSING LIQUID AND A POST-PROCESSING LIQUID, AND AN IMAGE FORMING METHOD USING A PRE-PROCESSING LIQUID AND A POST-PROCESSING LIQUID

(71) Applicants: Kazuki Yasu, Tokyo (JP); Yoshinari Suzuki, Kanagawa (JP); Yukihito Niino, Tokyo (JP); Seiya Murata, Kanagawa (JP)

(72) Inventors: Kazuki Yasu, Tokyo (JP); Yoshinari Suzuki, Kanagawa (JP); Yukihito Niino, Tokyo (JP); Seiya Murata, Kanagawa (JP)

(73) Assignees: Ricoh Company, Ltd., Tokyo (JP); SCREEN HOLDINGS CO., LTD., Kyoto-shi (JP)

( * ) Notice: Subject to any disclaimer, the term of this patent is extended or adjusted under 35 U.S.C. 154(b) by 335 days.

(21) Appl. No.: 13/875,070

(22) Filed: May 1, 2013

(65) Prior Publication Data

US 2013/0293645 A1 Nov. 7, 2013

(30) Foreign Application Priority Data

May 1, 2012 (JP) ..... 2012-104793
Apr. 25, 2013 (JP) ..... 2013-092704

(51) Int. Cl.
*B41J 11/00* (2006.01)
*B41J 2/21* (2006.01)
*B41J 15/04* (2006.01)

(52) U.S. Cl.
CPC ..... *B41J 11/0015* (2013.01); *B41J 2/2114* (2013.01); *B41J 15/04* (2013.01)

(58) Field of Classification Search
CPC ..... B41J 2/2114; B41J 11/0015; B41J 15/04
USPC ..... 347/14, 16, 19, 95, 96, 100–102
See application file for complete search history.

(56) References Cited

U.S. PATENT DOCUMENTS 6,467,891 B2 10/2002 Moriyama et al.

(Continued)

FOREIGN PATENT DOCUMENTS

JP 7-156538 A 6/1995
JP 2001-1509 A 1/2001

(Continued)

OTHER PUBLICATIONS

U.S. Appl. No. 13/874,849, filed May 1, 2013, Nino, et al.

*Primary Examiner* — Manish S Shah
*Assistant Examiner* — Roger W Pisha, II
(74) *Attorney, Agent, or Firm* — Oblon, McClelland, Maier & Neustadt, L.L.P.

(57) ABSTRACT

Disclosed is an image forming apparatus including an image forming unit that ejects droplets from an image forming apparatus, and forms an image on a surface of a printing medium, a pre-processing unit that applies a pre-processing liquid to the surface of the printing medium before the image is formed by the image forming unit, and a post-processing unit that applies a post-processing liquid different from the pre-processing liquid to the surface of the printing medium after the image is formed by the image forming unit. The pre-processing unit applies an amount of the pre-processing liquid which is determined based on a type of the printing medium and the post-processing unit applies an amount of the post-processing liquid which is determined based on the type of the printing medium.

7 Claims, 14 Drawing Sheets

(56) References Cited

U.S. PATENT DOCUMENTS

| | | | | |
|---|---|---|---|---|
| 7,338,143 | B2 | 3/2008 | Onishi et al. | |
| 2002/0015085 | A1* | 2/2002 | Moriyama et al. | 347/101 |
| 2005/0243121 | A1* | 11/2005 | Onishi | 347/21 |
| 2013/0106946 | A1 | 5/2013 | Sunaoshi | |

FOREIGN PATENT DOCUMENTS

| | | | |
|---|---|---|---|
| JP | 2002-96454 | A | 4/2002 |
| JP | 2005-7649 | A | 1/2005 |
| JP | 2011-183336 | A | 9/2011 |
| JP | 2012-40750 | A | 3/2012 |

* cited by examiner

IMAGE FORMING APPARATUS USING A PRE-PROCESSING LIQUID AND A POST-PROCESSING LIQUID, AND AN IMAGE FORMING METHOD USING A PRE-PROCESSING LIQUID AND A POST-PROCESSING LIQUID

CROSS REFERENCE TO RELATED APPLICATIONS

The present application claims priority to Japanese Patent Application 2013-092704, filed on Apr. 25, 2013, which claims priority to Japanese Patent Application 2012-104793, filed on May 1, 2012, the entire contents of both are incorporated herein by reference.

BACKGROUND OF THE INVENTION

1. Field of the Invention

Embodiments of the present invention relate to an image forming apparatus and an image forming method.

2. Description of the Related Art

The inkjet image forming method has rapidly been adopted in recent years due to the method's advantageous property of being an easy enhancement for a method of forming color images, as well as the fact that the method is noiseless and has a low running cost.

JP-A No. H10-226055 discloses a preliminary process of ejecting ink after ejecting a processing liquid onto a printing medium and a post-process of ejecting the processing liquid after ejecting the ink on the printing medium.

With the technology disclosed in the above-described document, however, the processing liquid makes a coloring agent in the ink insoluble or coagulated. As a result, when the printing medium on which an image is formed by the ink is scraped against an object (e.g., the other printing medium), a part of the image is occasionally peeled off.

SUMMARY OF THE INVENTION

The embodiments of the present invention have been developed in view of the above-described problems of the conventional techniques.

An objective of the embodiments of the present invention is to provide an image forming apparatus and an image formation method that can improve the abrasion resistance of the printing medium on which the image is formed.

In one aspect, there is provided an image forming apparatus including an image forming unit configured to eject droplets from an image forming apparatus, and to form an image on a surface of the printing medium, a pre-processing unit configured to apply a pre-processing liquid to the surface of the printing medium before the image is formed by the image forming unit, and a post-processing unit configured to apply a post-processing liquid different from the pre-processing liquid to the surface of the printing medium after the image is formed by the image forming unit. The pre-processing unit applies an amount of the pre-processing liquid which is determined based on the type of the printing medium and the post-processing unit applies an amount of the post-processing liquid which is determined based on the type of the printing medium.

In another aspect, there is provided an image forming method including the steps of applying the pre-processing liquid to a surface of the printing medium, forming an image on the surface of the printing medium on which pre-processing liquid was applied, and applying the post-processing liquid different from the pre-processing liquid to the surface of the printing medium on which the image is formed, wherein the pre-processing liquid is applied in an amount which is determined based on the type of the printing medium and the post-processing liquid is applied in an amount which is determined based on the type of the printing medium.

According to the embodiments of the present invention, there is provided the image forming apparatus and the image formation method that can improve the abrasion resistance of the printing medium on which the image is formed.

DETAILED DESCRIPTION OF THE PREFERRED EMBODIMENTS

Figure 1:
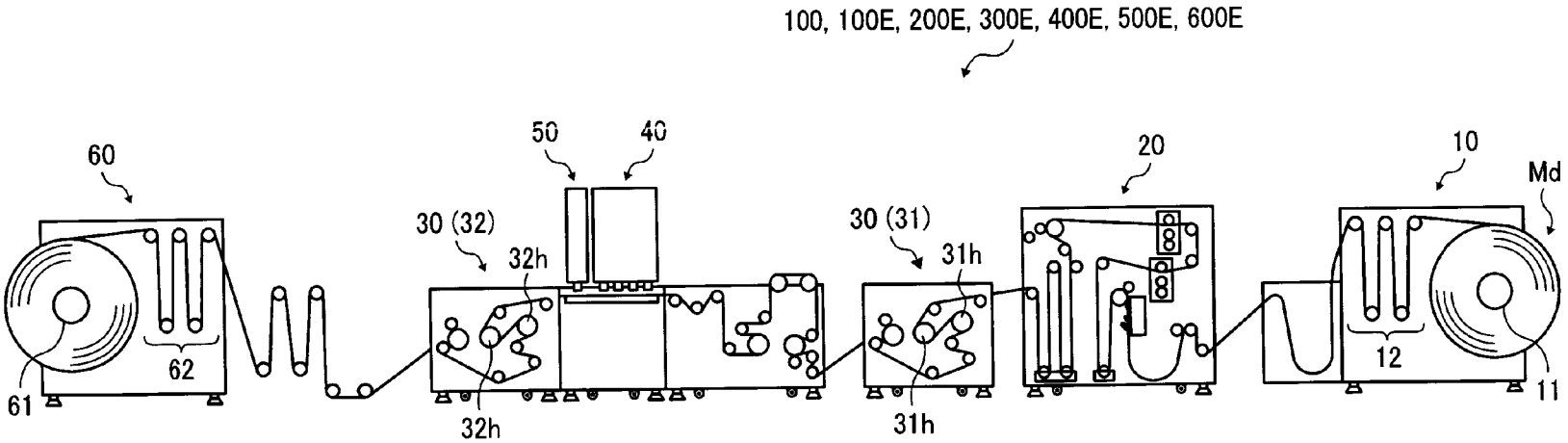
FIG. 1 is a schematic side view showing an example of the image forming apparatus according to one embodiment of the present invention.

Hereinafter, embodiments of the present invention will be explained with reference to an inkjet image forming apparatus. This invention can be also applied to any image forming apparatus having an ejecting unit (ejecting head, ink head, recording head, or the like) that forms (prints or the like) an image on a printing medium by ejecting recording liquid droplets (ink or the like) such as a facsimile device, a copier device, a multi-function peripheral, the like, or any device not specifically described herein. Embodiments of the present invention will be explained in the following order.

1. Configuration of an image forming apparatus
2. Configuration of a sheet feeding unit
3. Configuration of a pre-processing unit
4. Configuration of a drying unit
5. Configuration of an image forming unit
6. Configuration of a post-processing unit
7. Configuration of a sheet discharging unit
8. Configuration of a controlling unit
9. A first exemplary embodiment (an example in which the amount of post-processing liquid is determined based on type of the printing medium)
10. A second exemplary embodiment (an example in which the amount of post-processing liquid is determined based on amount of pre-processing amount)
11. A third exemplary embodiment (an example in which an amount of post-processing liquid is adjusted based on type of the printing medium)
12. A fourth exemplary embodiment (an example of adding a determination of drying strength to the first example)
13. A fifth exemplary embodiment (an example of adding a determination of drying strength to the second example)
14. A sixth exemplary embodiment (an example of adding a determination of drying strength to the third example)

The Configuration of an Image Forming Apparatus

The structure of an image forming apparatus 100 according to an embodiment of the present invention is explained with reference to FIGS. 1 to 5.

Although the present invention has been described using an image forming apparatus having ejecting heads (recording head, print heads, ink heads) corresponding to the four colors black (K), cyan (C), magenta (M), and yellow (Y), the scope of the present invention is not limited to an image forming apparatus having such ejecting heads. The scope of the present invention also includes an image forming apparatus having ejecting heads corresponding to green (G) red (R), light cyan (LC), and/or other color(s), or an image forming apparatus having only an ejecting head corresponding to black (K). In the following explanation, Y, C, M, and K represent the colors of yellow, cyan, magenta, and black.

Although the present invention has been described with reference to a continuous sheet in the form of a roll (hereinafter referred to as "sheet roll Md") as the printing medium, the printing medium used by the printing apparatus of the present invention is not limited to the sheet roll. The printing medium used by the printing apparatus of the present invention may also be a cut sheet. The scope of the printing medium used by the printing apparatus of the present invention includes any medium on which an image can be formed by liquid droplets on the surface of the medium such as standard paper, high quality paper, thick paper, thin paper, cut sheet, sheet roll, an OHP sheet, synthetic resin film, and metal thin film. The continuous sheet form includes perforated box paper or unperforated roll paper. A page of the box paper, for example, corresponds to an area between one perforation and next perforation.

As shown in FIG. 1, the image forming apparatus 100 according to an embodiment includes a sheet feeding unit 10 that feeds the sheet roll Md (printing medium), a pre-processing unit 20 that applies a pre-processing to the sheet roll Md, which is fed by the sheet feeding unit 10, and a drying unit 30 that dries the sheet roll Md, which is treated by the pre-process unit 20. Furthermore, the image forming apparatus 100 includes an image forming unit 40 that forms an image on a surface of the sheet roll Md, a post-processing unit 50 that applies a post-processing to the sheet roll Md, on which an image is formed by the image forming unit 40, and a sheet discharging unit 60 that discharges the sheet roll Md, which is treated by the post-processing unit 50.

The sheet feeding unit 10 of the image forming apparatus 100 according to an embodiment feeds the sheet roll Md, the pre-processing unit 20 applies pre-processing to the surface of the sheet roll Md, and the drying unit 30 dries the surface of the sheet roll Md. The image forming unit 40 of the image forming apparatus 100 forms an image on the surface of the sheet roll Md, which has been treated by the pre-processing and has been dried. Furthermore, the post-processing unit 50 of the image forming apparatus 100 applies the post-processing to the sheet roll Md on which is formed an image. Then, the sheet discharging unit 60 of the image forming apparatus 100 rolls up (discharges) the sheet roll Md.

Hereinafter, each component of the image forming apparatus 100 according to the present invention will be concretely described. The image forming apparatus 100 controls the pre-processing unit 20, the drying unit 30 (*a* pre-processing liquid drying unit 31, or a post-processing liquid drying unit 32) or post-processing unit 50 based on type of printing medium. The image forming apparatus 100 is able to exclude the drying unit 30 or the like.

The Configuration of the Sheet Feeding Unit

The sheet feeding unit 10 feeds a printing medium to the pre-processing unit 20. In this embodiment, the sheet feeding unit 10 includes a sheet holder 11, and a plurality of conveyance rollers 12. The conveyance rollers 12 of the sheet feeding unit 10 convey a sheet roll Md which is held by the sheet holder 11 to the pre-processing unit.

The Configuration of the Pre-Processing Unit

The pre-processing unit 20 treats a printing medium before an image is formed by the image processing unit 40 on the printing medium. In this embodiment, the pre-processing unit 20 treats a surface of the sheet roll Md which is conveyed by the feeding unit 10. The pre-processing unit 20 treats the surface with a pre-processing liquid.

A pre-processing is a process of uniformly applying the pre-processing liquid to a surface of the sheet roll Md (printing medium). The pre-processing liquid has a function of aggregating ink droplets.

The pre-processing process enables the image forming apparatus 100 to apply a pre-processing liquid, which has the function of aggregating ink droplets on a surface of the printing medium before the image processing unit 40 forms an image on the printing medium, when an image is formed by the image forming apparatus 100 on a different printing medium from a sheet intended for inkjet formation. The pre-processing process enables the image forming apparatus 100 to reduce and address problems such as bleeding of the image, problems related to image density, problems related to image tone, ink strike-through, problems related to water resistance, and problems related to environment resistance. That is, the image forming apparatus 100 is able to improve the quality of an image which is formed on the printing medium as a result of the application of the pre-processing liquid, which has a function of aggregating ink droplets on the printing medium, by the pre-processing unit 20 before the image forming unit 40 forms the image on the printing medium.

Additionally, the image forming apparatus 100 may apply the pre-processing liquid, which has the function of aggregating ink droplets on the sheet designated for inkjet, by the pre-processing unit 20, before the image forming unit 40 forms the image on the sheet designated for inkjet.

The pre-processing method performed by the pre-processing unit 20 according to an embodiment is not restricted and can be implemented appropriately according to the object. Examples of the method for applying include a blade coating method, a gravure coating method, a gravure offset coating method, a bar coating method, a roll coating method, a knife coating method, an air knife coating method, a comma coating method, a U-comma coating method, an AKKU coating method, a smoothing coating method, a micro gravure coating method, a reverse roll coating method, a 4-roll or 5-roll coating method, a dip coating method, a curtain coating method, a slide coating method and a die coating method.

The pre-processing unit 20 according to an embodiment is able to use a treating liquid, which includes water soluble aliphatic amino acids as the pre-processing liquid. The treating liquid, which includes water soluble aliphatic amino acids, has the behavior of aggregating water-dispersible colorant. The aggregating converges each of the water-dispersible colorant particles.

Furthermore, the pre-processing unit 20 is able to adsorb ions onto the surface of the water-dispersible colorant by adding an ionic object such as water soluble aliphatic amino acids into the pre-processing liquid. This enables the pre-processing unit 20 to neutralize the surface charge of the water-dispersible colorant. This also enables the pre-processing unit 20 to aggregate more of the water-dispersible colorant by increasing the aggregation resulting from the force between the molecules.

An embodiment of a pre-processing unit 20 using a roll coating method will be described with reference to FIG. 2.

Figure 2:
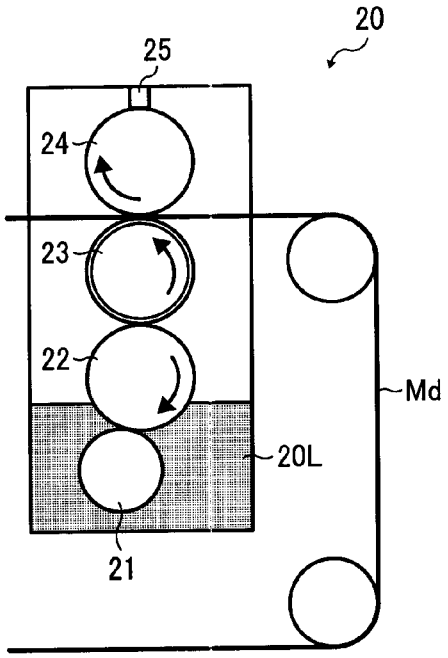
FIG. 2 is a schematic configuration view showing an example of a pre-processing unit of the image forming apparatus according to one embodiment of the present invention.

As shown in FIG. 2, the pre-processing unit applies a pre-processing liquid 20L, which is stored in the pre-processing unit 20, to a surface of the sheet roll Md, which is conveyed (fed) to the pre-processing unit 20 by the feeding unit 10 (FIG. 1).

Specifically, a stirring roller 21 and a transferring roller 22 first form the pre-processing liquid 20L as a thin film on a surface of an applying roller 23. Next, the pre-processing unit 20 presses the applying roller 23 onto a platen roller 24 and rotates the applying roller 23. In this state, the pre-processing unit 20 conveys the sheet roll Md to a place between the applying roller 23 and the platen roller 24. This enables the pre-processing liquid 20L to be applied to a surface of the sheet roll Md.

A pressure controller 25 of the pre-processing unit 20 controls the nip pressure between the applying roller 23 and the platen roller 24 when the pre-processing unit applies the pre-processing liquid 20L. The nip pressure is a force acting on a contact position between the applying roller 23 and the platen roller 24. The pre-processing unit 20 is able to control (change) the application amount of the pre-processing liquid to the sheet roll Md by controlling (changing) the nip pressure by the pressure controller 25. The application amount of the pre-processing liquid relates to the amount of liquid, the amount of applying, the amount of liquid after drying, and the thickness of the liquid film.

Furthermore, the pre-processing unit 20 controls the rotation speed of the applying roller 23 and the platen roller 24. The pre-processing unit is able to control (change) the application amount of the pre-processing liquid by controlling (changing) the rotation speed of the applying roller 23 and the platen roller 24. Additionally, the pre-processing unit 20 may control the applying unit 23 and/or the platen roller 24 by controlling the power source (motor or the like) to drive the applying unit 23 and/or the platen roller 24.

Accordingly, the pre-processing unit 20 of the image forming apparatus according to an embodiment of present invention, implementing the roll coating method, is able to more uniformly apply a liquid to a surface of the sheet roll Md (printing medium) as compared with using the spray coating method. The pre-processing unit 20 of this embodiment is able to uniformly and thinly apply the pre-processing liquid 20L to a surface of the sheet roll Md even when the pre-processing liquid 20L has a high viscosity. The pre-processing unit 20 enables the image, which is formed after the implementation of the pre-processing method, to reduce the image bleeding by uniformly and thinly applying the pre-processing liquid 20L to the sheet roll Md. The pre-processing unit 20 also enables improvement in the image quality.

The pre-processing unit 20 of the image forming apparatus according to this embodiment is able to apply the amount of the pre-processing liquid 20L, suitable for the image forming method and post-processing method, to the sheet roll Md (printing medium) by controlling the amount of the pre-processing liquid using the applying roller 23 and/or the platen roller 24.

Furthermore, the pre-processing unit 20 of the image forming apparatus according to this embodiment is able to control the application amount of the pre-processing liquid 20L based on the type of the printing medium by controlling the amount of the pre-processing liquid using the applying roller 23 and/or the platen roller 24. The pre-processing unit 20 of the image forming apparatus 100 according to this embodiment is able to improve the image quality because the pre-processing unit 20 is able to control the application amount of the pre-processing liquid 20L.

Configuration of the Drying Unit

The drying unit 30 implements drying of the printing medium by heating or the like. As shown in FIG. 1, the drying unit 30 in this embodiment includes the pre-processing liquid drying unit 31, which dries the sheet roll Md which was treated by the pre-processing unit 20, and the post-processing liquid drying unit 32, which dries the sheet roll Md which was treated by the post-processing unit 50. The drying unit 30 of the image forming apparatus 100 according to this embodiment includes rollers 31*h*/32*h* and controls the drying strength of the pre-processing liquid drying unit 31 and/or the drying strength of the post-processing liquid drying unit 32 based on the type of printing medium. A configuration of the pre-processing liquid drying unit 31 will be described with reference to FIG. 3.

Figure 3:
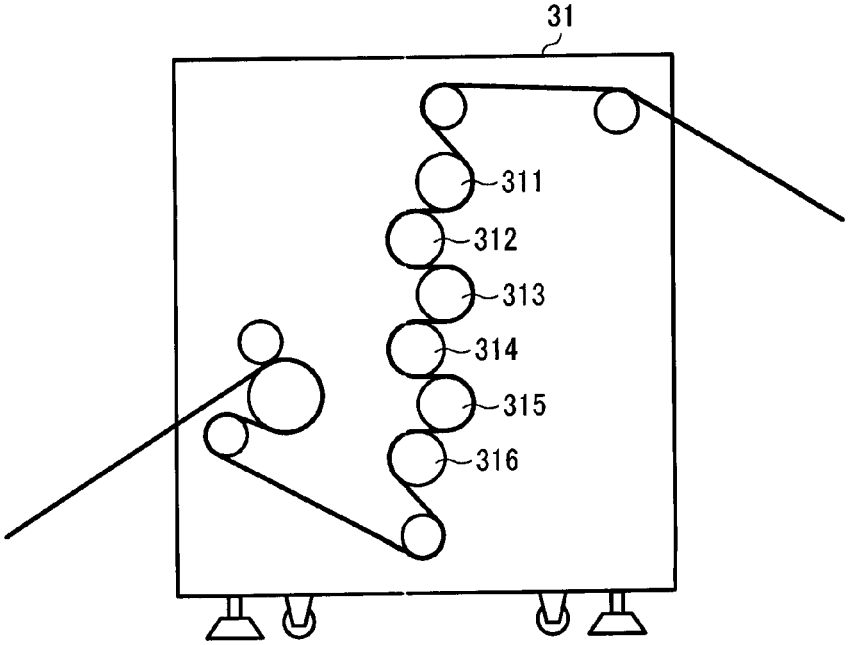
FIG. 3 is a schematic configuration view showing an example of a drying unit of the image forming apparatus according to one embodiment of the present invention.

As shown in FIG. 3, the pre-processing liquid drying unit 31 of this embodiment uses a plurality of heating rollers 311 to 316 to increase the drying effect. The pre-processing liquid drying unit 31 controls (changes) the drying strength based on the type of printing medium. Furthermore, the pre-processing liquid drying unit 31 also can control the drying strength based on the application amount of the pre-processing liquid 20L per unit area.

Specifically, the heating roller 311 (or 312 or the like) is heated from 40 degrees C. to 80 degrees C., and a surface of the sheet roll Md, on which was applied the pre-processing liquid 20L, contacts to the heating roller 311 (or 312, or the like). This enables the pre-processing liquid drying unit 31 to dry the sheet roll Md (by drying the pre-processing liquid on the sheet roll Md) thereby evaporating the water in the pre-processing liquid due to the heating of the surface of the sheet roll Md by the heating roller 311 (or 312, or the like)

The pre-processing liquid drying unit 31 lowers the temperature of the heating roller 311 (312, etc) when the pre-processing liquid drying unit 31 lowers the drying strength. For example, the pre-processing liquid drying unit 31 lowers the temperature when ink is used which has low penetrability, and raises the temperature when ink is used which has high penetrability. The pre-processing liquid drying unit heats the heating unit 311 (or 312 or the like) from 40 degrees C. to 80 degrees C., for example.

Furthermore, the pre-processing liquid drying unit 31 may control the drying strength by controlling the number of heating rollers which are used. In such a manner heating roller 311 and heating roller 312 may be heated and the other heating rollers are not heated. Additionally, the pre-processing liquid drying unit 31 is able to control the drying strength by controlling both the temperature of the heating roller and the number of rollers which are used. In addition, the pre-processing liquid drying unit 31 is able to implement control by only controlling the temperature of the heating roller or the number of heating rollers which are used.

A description of the configuration of the post-processing liquid drying unit 32 will be omitted due to the similarities to the pre-processing liquid drying unit 31. Additionally, the post-processing liquid drying unit 32 is able to control the drying strength based on the type of printing medium. Furthermore, the post-processing liquid drying unit 32 also is able to control the drying strength based on the amount of the post-processing liquid 50L applied by the post processing unit 50 per unit area.

Accordingly, the drying unit 30 (the pre-processing liquid drying unit 31 and the post-processing liquid drying unit 32) are able to control the drying strength by controlling the temperature of the heating roller and/or the number of the heating rollers which are used. The drying unit 30 of the image forming apparatus 100 according to this embodiment is able to optimize the drying strength for the printing medium based on the type of printing medium, because the drying unit 30 is able to control the drying strength. Furthermore, the drying unit 30 of the image processing unit 100 according to this embodiment is able to prevent the contraction of the printing medium by preventing excessive drying of the pre-processing liquid. The drying unit 30 is also able to prevent degradation of image quality by preventing the under drying of the pre-processing liquid. This is accomplished by controlling the drying strength of the pre-processing liquid drying unit 31 based on the type of printing medium. That is, the image forming apparatus 100 according to this embodiment is able to improve the image quality (printing quality).

The drying unit 30 of the image forming apparatus 100 according to this embodiment is able to improve the image quality because the degradation of the fastness property of the image is prevented by the prevention of under drying of the post-processing liquid. This is accomplished by controlling the drying strength of the post-processing liquid drying unit 32 based on the type of printing medium. Furthermore, the drying unit 30 of the image forming apparatus according to this embodiment is able to prevent the contraction of the printing medium by preventing over drying. This is accomplished by controlling the drying strength of the post-processing liquid drying unit 32 based on the type of printing medium.

The ink may include an additive such as glycerin for maintaining the physical property values, such as viscosity and surface tension, of the ink in order that the inkjet image forming apparatus is able to eject ink droplets having the same condition. When prepared ink is used, the penetrability of the ink and glossiness of the printed image will be different according to the type of printing medium. The drying unit 30 of the image forming apparatus 100 according to this embodiment is able to optimize the drying of the pre-processing liquid or post processing liquid to the ink when the image forming unit 40 uses low penetrability ink. This enables the drying unit 30 according to this embodiment to prevent the occurrence of problems such as the degradation of image quality due to under drying of the pre-processing liquid, and the peeling off of part of the image on the printing medium due to scrapping against an object (e.g., the other printing medium) before the post-processing liquid is dry. The drying unit 30 according to this embodiment is able to improve the image quality (printing quality) by preventing the contraction of the printing medium due to over drying, when the image forming unit 40 uses high penetrability ink.

The drying unit 30 according to present invention is not limited to using the heating roller as the drying method. That is, the drying unit 30 is able to use any drying method such as an infrared ray drying method, a microwave drying method, or a hot-air drying method. The drying unit 30 is able to use a plurality of methods in combination. Furthermore, the drying unit 30 is able to heat (pre-heat) the sheet roll Md (printing medium) before the pre-processing unit 20 applies the pre-processing liquid.

The Configuration of the Image Forming Unit

The image forming unit 40 forms an image on a printing medium. The image forming unit 40 of this embodiment forms an image on a surface of the sheet roll Md by ejecting recording liquid droplets (ink or the like) on the sheet roll Md which was dried by the drying unit 30.

Figure 4:
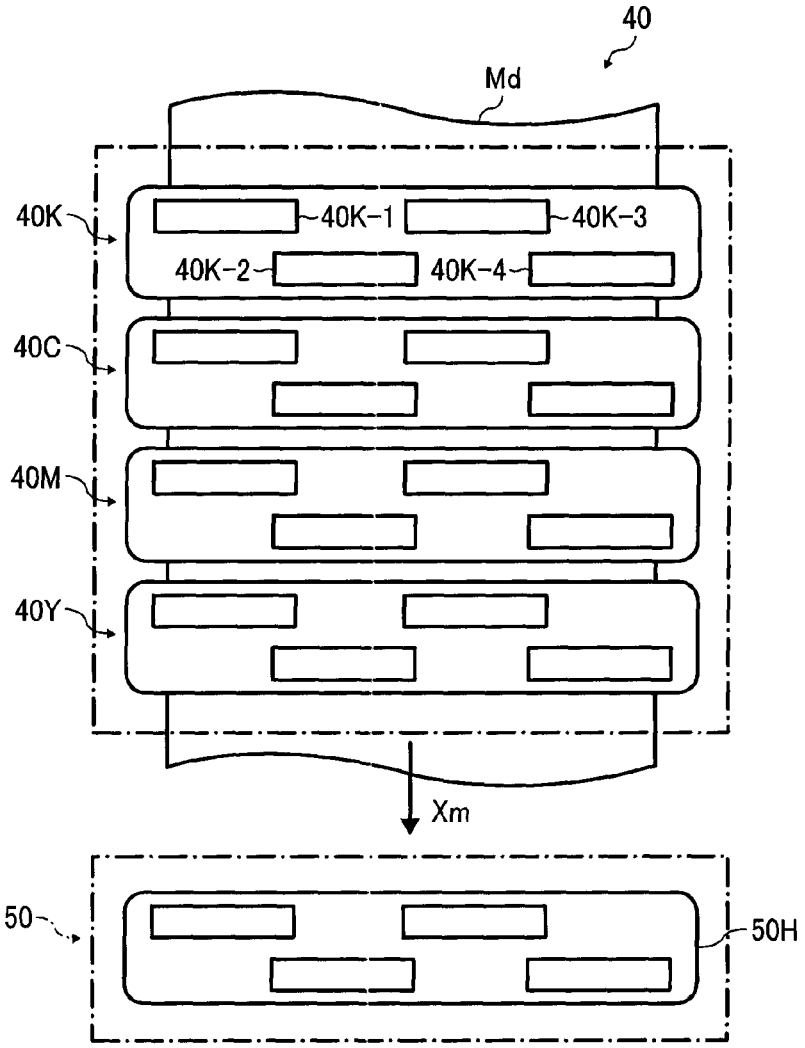
FIG. 4 is a schematic plan view showing an example of an image forming unit and a post-processing unit of the image forming apparatus according to one embodiment of the present invention.
Figure 5:
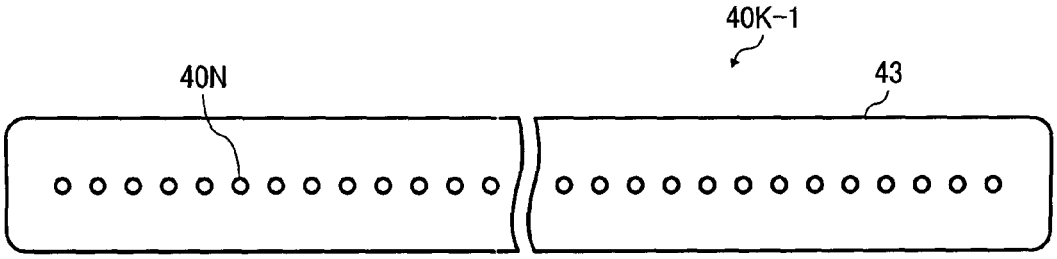
FIG. 5 is a schematic plan view showing an example of a head unit of an ejecting head for ejecting the black color ink of the image forming unit according to one embodiment of the present invention.

An example of an external structure of the image forming unit 40 will be described with reference to FIGS. 4 and 5. FIG. 4 is a schematic plan view showing an example of the image forming unit 40 and a post-processing unit 50 of the image forming apparatus 100 according to this embodiment. FIG. 5 is a schematic plan view showing an example of a head unit of an ejecting head for ejecting the black color ink of the image forming unit 40.

As shown in FIG. 4, the image forming unit 40 is able to use full-line heads. That is, the image forming unit 40 includes four ejecting heads 40K, 40C, 40M, and 40Y for different colors, black (K), cyan (C), magenta (M), and yellow (Y), in this order from the upstream to the down stream in a printing medium conveyance direction Xm.

The ejecting head 40K for ejecting the black (K) color ink includes four head units 40K-1, 40K-2, 40K-3, 40K-4, which are arranged in a staggered manner in the direction perpendicular to the printing medium conveyance direction Xm. This enables the image forming apparatus 40 to form an image in the entire width image forming range (printing range) of the sheet roll Md (printing medium). A description of the configuration of the other ejecting heads 40C, 40M, and 40Y is omitted due to the similarities to the ejecting head 40K.

FIG. 5 is an enlarged plan view showing a head unit 40K-1 of the ejecting head 40K for ejecting the black color ink of the image forming unit 40.

As shown in FIG. 5, the head unit 40K-1 has a plurality of ejection openings 40N (nozzles, printing nozzles) on the nozzle face. The plurality of ejection openings 40N are arranged along a longitudinal direction of the head unit 40K-1, and form the nozzle array. Additionally, the head unit 40K-1 may have a plurality of nozzle arrays.

Figure 6:
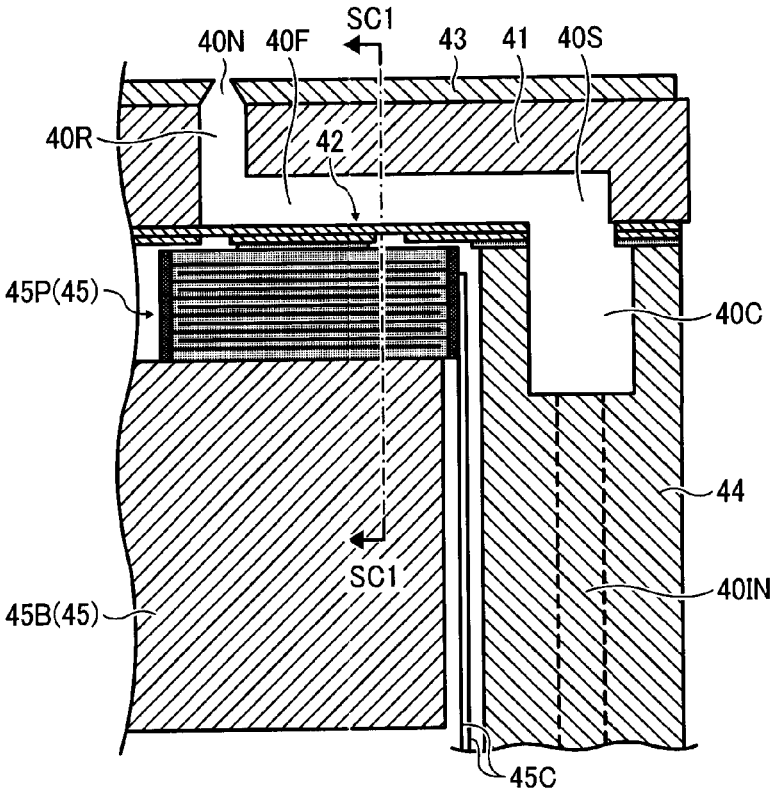
FIG. 6 is a cross sectional view showing an example of a cross section shown along a longitudinal direction of a liquid chamber.
Figure 7:
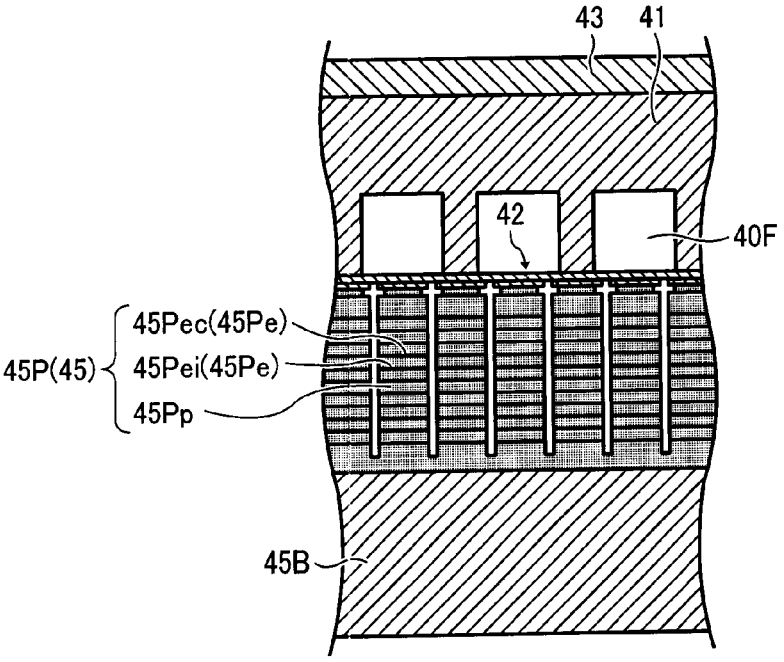
FIG. 7 is a cross sectional view showing an example of a cross section shown along a lateral direction of the liquid chamber.

A cross sectional view showing the ejecting head of the image forming unit 40 will be described with reference to FIGS. 6 and 7. FIG. 6 is a cross sectional view showing an example of the ejecting head in the longitudinal direction of a liquid chamber 40F of the image forming unit 40. FIG. 7 is a cross sectional view showing the ejecting head in the lateral direction (nozzle sequence direction) of the liquid chamber 40F of the image forming unit 40. FIG. 7 is a cross section view when viewed along a line SC1 in FIG. 6.

As shown in FIG. 6, the ejecting head is configured with a nozzle communication channel 40R that is a flow channel communicating with a nozzle 40N for ejecting a recording liquid droplet (ink droplet). The ejecting head is provided by jointing and stacking a flow channel plate 41, which is formed, for example, by anisotropically etching a single crystal silicon substrate. The ejecting head also is provided by a vibrating plate 42, which is jointed to the lower surface of the channel plate 41 and formed by means of, for example, nickel electroforming, and a nozzle plate 43 jointed to the top surface of the flow channel plate 41. A liquid chamber 40F is also provided that is a pressure generating chamber and an ink supplying port 40S is provided for supplying ink to the liquid chamber 40F through a fluid resistance part (supplying channel). The ink supplying port 40S also communicates with a common liquid chamber 40C, and the like.

Also, there is provided two lines of laminated-type piezoelectric elements 45P (that are not shown in the figures) acting as electromechanical elements which are pressure generating devices 45 (actuator devices) that pressurize ink in the liquid chamber 40F by deforming the vibrating plate 42. Also is provided a base substrate 45B for jointing and fixing the piezoelectric elements 45P.

Additionally, supporting pillar parts are provided between the piezoelectric elements 45P.

The supporting pillar parts are parts that are formed together with the piezoelectric elements 45P by dividing and processing each piezoelectric member. These pillars are simple supporting pillars since no driving voltage is applied thereon.

Also, FPC cables 45C on which driving circuits (driving IC) are mounted (not shown in the figures) are connected to the piezoelectric elements 45P.

The peripheral portion of the vibrating plate 42 is connected to a frame member 44. Recesses are provided for a perforation part for accommodating an actuator unit. The actuator unit is composed of the piezoelectric elements 45P, the base substrate 45B and the like. The common liquid chamber 40C and an ink supply port 401N for supplying ink from the outside the common liquid chamber 40C and the actuator unit are each formed on the frame member 44.

The frame member 44 is formed by means of injection molding of, for example, a thermosetting resin such as epoxy-type resins or a poly (phenylene sulphite).

Herein, the flow channel plate 41 is provided by forming recesses and holes which are provided for the nozzle communication channel 40R and the liquid chamber 40F. The recesses and holes are formed by, for example, anisotropically etching a single crystal silicon substrate with a crystallographic orientation (110) using an alkaline etching liquid such as an aqueous solution of potassium hydroxide (KOH). However, the present embodiment is not limited to a single crystal silicon substrate and other substrates such as a stainless substrate and photosensitive resins may also be used.

The vibrating plate 42 is formed from a metal plate of nickel and fabricated by, for example, an electroforming method (electrocasting method). However, other metal plates, jointing members of a metal and resin plates, and the like may also be used.

The piezoelectric elements 45P and the supporting pillar parts are jointed to the vibrating plate 42 with a bonding material and the frame member 44 is further jointed with a bonding material.

The nozzle plate 43 includes a nozzle with a diameter of 10-30 μm which is formed so as to correspond to each liquid chamber 40F. The nozzle plate 43 is jointed to the flow channel plate 41 with a bonding material. The nozzle plate 43 is formed such that a water-repellent layer is formed on the top surface of a desired layer on the surface of a nozzle forming member made of a metal member.

As shown in FIG. 7, the piezoelectric element 45P is a laminated-type piezoelectric element (herein, a PZT) provided by alternately laminating piezoelectric materials 45Pp and internal electrodes 45Pe.

A separate electrode 45Pei and a common electrode 45Pec are connected to each of internal electrodes 45Pe, which are alternately connected to the different end faces of the piezoelectric element 45P.

Additionally, in this embodiment, there is provided a configuration such that ink in the liquid chamber 40F is pressurized by deforming the piezoelectric element 45P in directions of d33 (i.e. a piezoelectric coefficient) as the directions of piezoelectricity. There may also be provided a configuration such that ink in the pressurized liquid chamber 40F is pressurized by deforming the piezoelectric element 45P in directions of d31 (i.e. another piezoelectric coefficient) as directions of piezoelectricity.

Also, there may also be provided a configuration in which one line of piezoelectric elements 45P is provided on one substrate 45B.

In the above configured liquid ejecting head, for example, when a voltage, applied to the piezoelectric element 45P, is lowered relative to a reference electric potential, the piezoelectric element 45P is contracted. This results in the vibrating plate 42 being lowered thereby increasing the volume of the liquid chamber 40F, such that ink flows into the liquid chamber 40F. Subsequently, the voltage applied to the piezoelectric element 45P is increased so that the piezoelectric element 45P extends in the directions of lamination, and the vibrating plate 42 is deformed toward the direction of the nozzle 40N. This results in a decrease in the volume of the liquid chamber 40F. Thereby, the recording liquid (ink) in the liquid chamber 40F is pressurized resulting in the ejection (jet) of a drop of recording liquid (ink) from the nozzle 40N.

When the voltage applied to the piezoelectric element 45P is set back to the reference electric potential, the vibrating plate 42 is restored to the initial state and the liquid chamber 40F expands generating a negative pressure. The inside of the liquid chamber 40F is then once again filled with recording liquid (ink) from the common liquid chamber 40C.

After the vibration of a meniscus surface at the nozzle 40N is damped and is stabilized, transition to an operation for the next liquid drop ejection is made.

Additionally, the manner of driving the head is not limited to the above example (pull-push-ejection) but pull-ejection or push-ejection may also be used depending on a manner of providing a driving wave pattern.

Accordingly, the image forming apparatus 100 according to this embodiment is able to form a full-color image or a monochrome image in the entire width image forming range using the image forming unit 40 (the ejecting units 40K, 40C, 40M, and 40Y) during a single conveyance of the printing medium (sheet roll Md).

Additionally, the pressure generating devices 45 of the present invention are not limited to the above described example (the piezoelectric element 45P). That is, the pressure generating device 45 may include, for example, a thermal actuator including an electrothermal converter element such as a heating resistor or the like applying a phase change in a liquid by film boiling. The pressure generating device 45 may also include a shape memory alloy actuator that applies metallic phase change by a temperature variation, or an electrostatic actuator that applies electrostatic force generating a pressure for jetting a liquid droplet.

The Configuration of the Post-Processing Apparatus

The post-processing unit 50 treats the printing medium on which an image has been formed. In this embodiment, the post-processing unit 50 treats a surface of the sheet roll Md on which an image was formed by the image forming unit 40. The post-processing unit 50 treats the surface using a post-processing liquid.

As shown in FIG. 4, the post-processing unit 50 in this embodiment is arranged downstream from the image forming unit 40 in a printing medium conveyance direction Xm. The post-processing unit 50 includes post-processing head units 50H which are arranged in a staggered manner in the direction perpendicular to the printing medium conveyance direction Xm. Furthermore, the post-processing unit 50 controls the ejection (application) amount of the post-processing liquid by controlling a driving wave pattern input to the post-processing head units 50H. This configuration enables the post-processing unit 50 to eject (apply) the post-processing liquid to the entire width image forming range (printing range) of the sheet roll Md (printing medium). A description of the configuration of post-processing head unit 50H will be omitted due to the similarities to the configuration of the image forming unit 40 (FIGS. 4 to 7).

Figure 8:
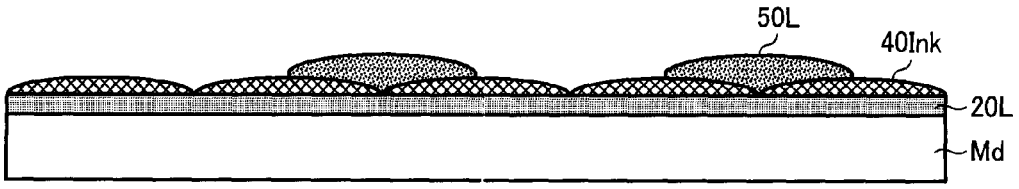
FIG. 8 is an illustration showing an example of the printing medium on which the image is formed by the image forming apparatus according to one embodiment of the present invention.

The post-processing is a process of ejecting (depositing) the post-processing liquid onto the sheet roll Md (printing medium). The post-processing liquid is deposited in the shape of dots or stripes. This enables an improvement in the abrasion resistance, glossiness, and preservation stability (the environmental resistance, the water resistance, and the gas resistance, or the like) of the printing medium on which image was formed. As shown in FIG. 8, when the post-processing unit starts the post-processing, a surface of the sheet roll Md has the pre-processing liquid 20L and the ink 40Ink for forming an image applied thereon. The post-processing unit 50 of the image forming apparatus 100 according to this embodiment performs the process of ejecting (depositing) the post-processing liquid 50L onto the sheet roll Md on which the image was formed.

Furthermore, the post-processing unit 50 of the image forming apparatus 100 according to this embodiment is able to eject the post-processing liquid 50L onto a smaller area than the surface area on which the pre-processing liquid 20L was applied. The post-processing unit 50 of the image forming apparatus 100 according to this embodiment is also able to eject the post-processing liquid 50L onto a smaller area than the surface area on which the image was formed.

That is, the post-processing liquid 50L is ejected (deposited) to a smaller area than the surface area on which the pre-processing liquid 20L was applied. In FIG. 8, the ink 40Ink is ejected onto the entire area, and the post-processing liquid 50L is ejected (deposited) to a smaller area than the entire area.

Additionally, FIG. 8 illustrates that the post-processing liquid 50L is formed in the shape of dots. However, the post-processing liquid may also be formed in the shape of stripes in the direction perpendicular to the cross section.

As shown in FIG. 8, this embodiment describes that the post-processing liquid 50L is ejected (deposited) onto a smaller area than the surface area on which the image is formed within the area in which the image is formed. However, the post-processing liquid 50L may be ejected (deposited) onto an area in which an image is not formed. In addition, the post-processing liquid 50L may not be ejected (deposited) onto the area in which an image is not formed.

When the printing medium, which is formed according to the shape shown in FIG. 8, is scraped against an object, a surface part of a layer of the post-processing liquid 50L is scraped against the object. Thus, the post-processing liquid 50L prevents not only the ink 40Ink of the area on which the post-processing liquid 50L is applied from peeling off, but also the ink 40Ink of the area on which the post-processing liquid 50L is not applied from peeling off, because the layer of the post-processing liquid 50L has a greater thickness.

Accordingly, the image forming apparatus 100 according to an embodiment of present invention can eject (deposit) the post-processing liquid 50L using the post-processing unit 50 onto the printing medium (sheet roll Md) on which an image was formed. This enables the image forming apparatus 100 according to this embodiment to prevent the image (ink) which is printed on the printing medium (sheet roll Md) from peeling off by being scraped against an object (e.g., the other printing medium). Thus, the ink is better maintained as compared with when the post-processing liquid is not ejected (not deposited). That is, the image forming apparatus 100 is able to improve the abrasion resistance of the image formed on the printing medium by using the features of the post-processing unit 50.

The image forming apparatus 100 is able to improve the quality of image formed on the printing medium, because the post-processing unit 50 is able to deposit (eject) the post-processing liquid 50L onto the printing medium (sheet roll Md) on which an image was formed. That is, the image forming apparatus 100 is able to reduce problems such as bleeding of the image, problems related to image density, problems related to image tone, an ink strike-through, problems related to water resistance, or problems related to environmental resistance. This reduction is due to the post-processing unit 50 depositing (eject) the post-processing liquid 50L onto the printing medium on which an image was formed.

The post-processing unit 50 of the image forming apparatus 100 according to this embodiment preferably ejects (deposits) the post-processing liquid 50L onto the area of the sheet roll Md on which an image was formed, as the post-processing method. Furthermore, the post-processing unit 50 preferably changes the ejection amount of the post-processing liquid 50L and/or the method of ejecting, based on the type and/or the penetrability and/or the glossiness of the printing medium, and/or type of the printing medium, and/or the application amount of the pre-processing liquid by the pre-processing unit 20.

The post-processing unit 50 according to this embodiment is able to eject the post-processing liquid at the amount which is needed, in the shape of dots if needed, in the shape of stripes if needed, and/or to the area where needed.

Specifically, the post-processing unit 50 is able to eject the post-processing liquid 50L onto any area described as follows. The post processing unit 50 is able to eject onto the area available for further image forming. The post processing unit 50 is able to eject onto the area on which an image was formed. The post processing unit 50 is able to eject onto the area on which ink droplets were ejected. The post-processing unit 50 is also able to eject onto a slightly (1 dot or 2 dots) larger area than the area on the sheet roll Md (printing medium) on which an image was formed. Furthermore, the post-processing unit is able to eject onto some percentage of the selected area (as the shape of dots or stripes).

The percentage may be from 5 to 50 percent. The percentage may be determined by the experiment or by numerical calculations.

The post-processing unit 50 is able to determine the ejection area using any determination method described as follows. The post-processing unit 50 is able to determine based on the print coverage rate. The post-processing unit 50 is able to determine based on the amount of ejecting of the post-processing liquid 50L. The post-processing unit 50 may also determine that the post-processing unit calculates the amount of ejecting of the post-processing liquid or the print coverage rate based on input information (printing image data or the like). The post-processing unit 50 then determines the ejection area based on the ejection amount of the post-processing liquid or the print coverage rate.

Accordingly, the post-processing unit 50 of the image forming apparatus according to an embodiment of present invention is able to eject (deposit) onto an area related to the area on which an image was formed. This enables the image forming apparatus 100 according to this embodiment to shorten the post-processing and drying time of the post-processing liquid. As a result, the image forming apparatus 100 according to this embodiment is able to reduce the amount of post-processing liquid as compared with the case in which the post-processing liquid is applied (ejected) to the entire surface of the printing medium. Furthermore, the image forming apparatus 100 according to this embodiment is able to reduce the cost of post-processing by reducing the amount of post-processing liquid as compared with the case in which the post-processing liquid is applied (ejected) to the entire surface of the printing medium.

Additionally, the post-processing method of the post-processing unit 50 is not particularly limited and is able to be appropriately selected according to the type of post-processing liquid. The post-processing method of the post-processing unit 50 is able to correspond to the pre-processing method of the pre-processing unit 20 or the ink ejecting method of the image processing unit 40. Furthermore, from the perspective of downsizing of the image forming apparatus and the perspective of the storage stability of the post-processing liquid, the post-processing method of the post-processing unit 50 is preferably the same method as the ink ejecting method of the image forming unit. In case of ejecting the post-processing liquid, the post-processing liquid preferably includes a water-soluble organic solvent. The water-soluble organic solvent may include a wetting agent. The wetting agent is added for the purpose of preventing clogging in the nozzle of the ejecting head. Such clogging is caused by the drying of the recording liquid (ink) in the ink ejecting method of the image forming unit 40.

The amount of the post-processing liquid on the sheet roll Md after drying is preferably from 0.5 g/m2 to 10 g/m2. The amount of the post-processing liquid on the sheet roll Md after drying is more preferably from 2 g/m2 to 10 g/m2. Additionally, when the amount of the post-processing liquid on the sheet roll Md after drying is less than 0.5 g/m2, the quality of the image (e.g., the abrasion resistance, glossiness, and preservation stability (e.g., the environmental resistance, the water resistance, and the gas resistance, or the like)) may be reduced. When the amount of the post-processing liquid on the sheet roll Md after drying is more than 10 g/m2, the drying characteristics of the layer of the post-processing liquid (a protective layer) may be reduced (e.g., it may take a long time to dry). Furthermore, when the amount of the post-processing liquid on the sheet roll Md after drying is more than 10 g/m2, the quality of the image may not be improved any further, which may be economically unfavorable.

The post-processing unit 50 according to this embodiment is able to use a treating liquid which includes a material forming a clear protective layer on the sheet roll. Md (printing medium) as the post-processing liquid. The treating liquid, which includes a material forming a clear protective layer, includes a water-based resin (a water-soluble resin or a water-dispersible resin), the water-soluble organic solvent (a wetting agent), a penetrating agent, a surfactant, water, and/or the other components. The post-processing liquid may be an ultraviolet curing resin composition and/or a thermoplastic resin composition. Furthermore, for improving the glossiness and fixability, the post-processing liquid is preferably a thermoplastic resin emulsion. This enables post-processing unit 50 to improve the glossiness of a surface of the sheet roll Md on which an image was formed, or to protect the surface of the sheet roll Md by the resin layer, based on the ejecting (applying) method.

Any type of water-based resin may be used depending on the purpose. For example, the following styrene-acrylic resin, urethane resin, acrylic silicone resin, a fluorine resin. The amount of water contained in the water based resin in the protective layer is preferably from 1% by mass to 50% by mass. Furthermore, when ejecting the post-processing liquid from the ejecting head, the amount of water contained in the water based resin in the protective layer is preferably from 1% by mass to 30% by mass. Additionally, when the amount of water contained in the water based resin is greater than the 50% by mass, viscosity of the post-processing liquid may be too high. When the amount of water contained in the water based resin is less than the 1% by mass, the amount of energy required by the post-processing unit for drying the water in the post-processing liquid may increase.

The average particle diameter of the water based resin in the post-processing liquid relates to the viscosity of the post-processing liquid. When the average particle is smaller the viscosity is greater. Accordingly, in order to prevent too great a viscosity of the post-processing liquid, the average particle diameter of the water based resin is preferably larger than 50 nm.

When the average particle diameter of the water based resin in post-processing liquid is tens of nano meters, the average particle diameter may be larger than the nozzle diameter. However, the average particle diameter is preferably smaller than the nozzle diameter (a diameter of the ejection opening 40N in FIG. 4). In addition, even though the average particle diameter of the water based resin in the post-processing liquid may be smaller than the diameter of the nozzle, when the water based resin merely includes any large diameter particle, the ability to eject may be deteriorated.

Accordingly, the average particle diameter of the water based resin in post-processing liquid is preferably smaller than 200 nm, more preferably smaller than 150 nm.

When using the water-soluble organic solvent (a wetting agent), the amount of water contained in the water-soluble organic solvent in post-processing liquid is not particularly limited. The amount of water contained in the water-soluble organic solvent may be from 10% by mass to 80% by mass. The amount of water contained in the water soluble organic solvent is preferably from 15% by mass to 60% by mass. The water-soluble organic solvent (a wetting agent) is for example, 1,3-butadiene, glycerin, or the like.

Additionally, when the amount of water contained in the water-soluble organic solvent is greater than 80% by mass, the drying characteristics of the post-processing liquid on the printing medium may be deteriorated. When the amount of water contained in the water-soluble organic solvent is less than 10% by mass, the components of the post-processing liquid may be changed as a result of mixing with the pre-processing liquid.

The penetrating agent and surfactant are not limited to particular chemicals. The penetrating agent is for example, 2-ethyl-1,3-hexanediol or the like. The surfactant is for example, polyethylene oxide end-capped with perfluoroalkyl or the like. As the penetrating agent and the surfactant used by the post-processing unit 50 the penetrating agent and surfactant included in the pre-processing liquid used by the pre-processing unit 20, and the ink used by the image forming unit 40 may each be arbitrarily selected.

Additionally, the post-processing liquid may include other components. The post-processing liquid may include, for example, wax, pH adjuster, antimicrobial agent, surface modifier, or antiforming agent.

The wax is, for example, polyethylene wax or the like. The pH adjuster is, for example, 2-amino-2-ethyl-1 3-propanediol or the like. The antimicrobial agent is, for example, 1,2-benzothiazolyl-3-one or the like. The surface modifier is, for example, polyether modified poly-dimethyl-siloxane (BYK-Chemie) or the like. The antiforming agent is, for example, 2,4,7,9-Tetramethyl-4,7-decanediol or the like.

The Configuration of the Sheet Discharging Unit

The sheet discharging unit 60 discharges the printing medium on which an image has been formed. As shown in FIG. 1, the sheet discharging unit 60 of this embodiment includes a sheet holder 61 and a plurality of conveyance rollers 62. The sheet discharging unit 60, using the conveyance rollers, rolls up the sheet roll Md on the roller of the sheet holder.

Additionally, when the pressure on the sheet roll Md is high during the process of the sheet roll Md being rolled up on the roller of the sheet holder 62, a drying unit for drying the sheet roll Md may be disposed adjacent to the entrance of the sheet holder 62 in order to prevent a transfer of the image to the reverse side of the sheet.

The Configuration of the Controlling Unit

The controlling unit 70 controls the action of the image forming apparatus 100. The controlling unit of this embodiment instructs each component in the image forming apparatus 100, and controls the action of the each component. The controlling unit 70 according to this embodiment will be described with reference to FIGS. 9 to 13.

Additionally, the image processing unit 100 may be a production printing system. The production printing system is a printing system which is able to print (form an image) to large volume printing matter (document) in a short period of time by efficiently controlling the job or the printing of the image data. Specifically, the image forming apparatus 100 (the controlling unit) according to this embodiment includes a plurality of apparatuses. One apparatus controls the order of printing job data, or transforms the printing job data to raster image data (RIP process). The other apparatus performs the printing based on the raster image data.

The image forming apparatus 100 (controlling unit 70) constructs a workflow system for managing production of print job data in order to distribute the printing matter. That is, the image forming apparatus 100 (controlling unit 70) is able to expedite the workflow process by distributing the process among the plurality of apparatuses.

Figure 9:
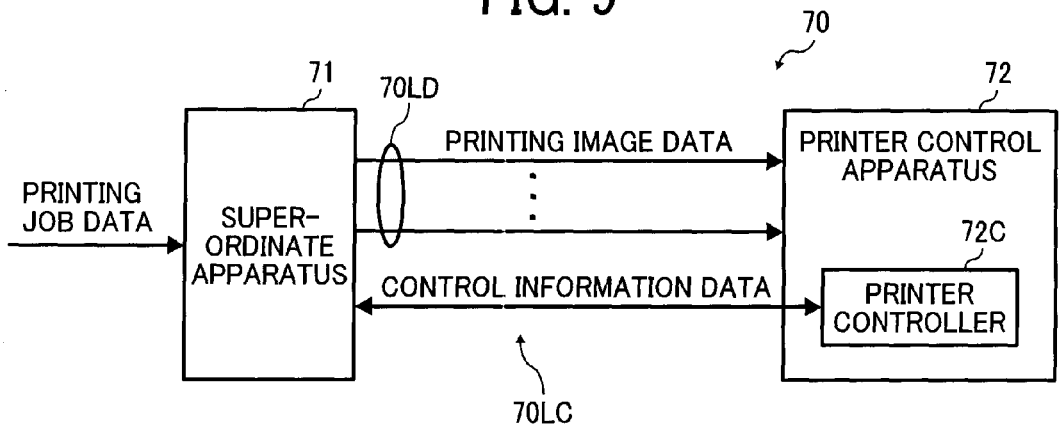
FIG. 9 is a schematic configuration view showing an example of a controlling unit of an image forming apparatus and a superordinate device of the controlling unit according to one embodiment of the present invention.

As shown in FIG. 9, the controlling unit 70 of the image forming apparatus 100 according to this embodiment includes a superordinate apparatus 71 (DFE, digital front end, RIP, raster image processor or the like) and a printer control apparatus 72. The superordinate apparatus 71 produces the raster image data (RIP process), for example. The printer control apparatus 72 is included in a printing apparatus for printing. The superordinate apparatus 71 and the printer control apparatus 72 are connected via a plurality of data lines 70LD and a plurality of control lines 70LC.

The superordinate apparatus 71 and the printer control apparatus 72 of the controlling unit 70 according to this embodiment will be explained in the following order.

The Superordinate Apparatus

The superordinate apparatus 71 is the apparatus that produces the raster image data (RIP process) based on the print job data (printing data, job data or the like) which is received from the host apparatus. That is, the superordinate apparatus 71 produces the raster image data (hereinafter referred to as printing image data) corresponding to the ink colors, based on the printing data. The printing image data includes the data relating to the ejection of the post-processing liquid by the post-processing unit 50 (hereinafter referred to as post-processing liquid image data).

The superordinate apparatus 71 produces data for controlling the printing action (hereinafter referred to as control information data), based on the print job data or the information of the host apparatus. The control information data includes the printing type, the printing form, the feeding and discharging of the sheet information and, the surface order of the printing, the size of the sheet for printing, the size of the printing image data, the resolution, the type of the sheet, the tonal range, the color information, the number of pages or the like. The control information data includes the ejection data of the post-processing liquid which is ejected by the post-processing unit 50 (hereinafter referred to as post-processing control data).

Figure 10:
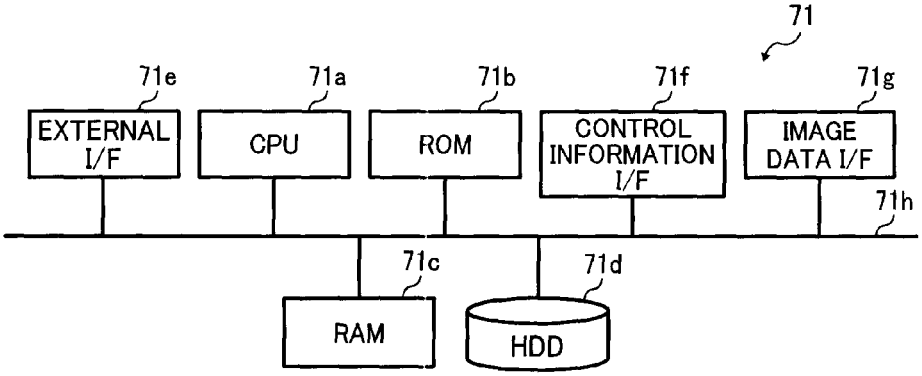
FIG. 10 is a schematic configuration view showing of an example of the superordinate device of the controlling unit according to one embodiment of the present invention.

As shown in FIG. 10, the superordinate apparatus 71 of this embodiment includes a CPU (Central Processing Unit) 71*a*, ROM (Read Only Memory) 71*b*, RAM (Random Access Memory) 71*c*, and HDD (Hard Disk Drive) 71*d*. The superordinate apparatus 71 includes an external interface 71*e*, a control information interface 71*f*, and an image data interface 71*g*. Moreover, the superordinate apparatus 71 includes a bus 71*h* which connects to the CPU 71*a* etc. That is, the CPU 71*a* etc. in the superordinate apparatus 71 can communicate via the bus 71*h*.

The CPU 71*a* controls the entire superordinate apparatus 51. The CPU 71*a* controls the action of the superordinate apparatus 71 by using a control program stored in the ROM 71*b* and/or HDD 71*d*.

The ROM 71*b*, the RAM 71*c*, and the HDD 71*d* store the data or the like. The ROM 71*b* and/or the HDD 71*d* originally store the control program for controlling the CPU 71*a*. The RAM 71*c* is used as the work memory of the CPU 71*a*.

The external interface 71*e* controls communication with the external image forming apparatus 100. The external interface 71*e* is able to control the communication corresponding to TCP/IP (Transmission Control Protocol/Internet Protocol).

The control information interface 71*f* controls the communication of control information data. The control information interface 71*f* is able to control the communication corresponding to PCI Express (Peripheral Component Interconnect Bus Express).

The image data interface 71*g* controls the communication of printing image data. The image data interface 71*g* is able to control communication corresponding to PCI Express. The image data interface 71*g* includes a plurality of channels corresponding to each color of the printing image data.

The superordinate apparatus 71 of the controlling unit 70 according to this embodiment receives the print job data from the host apparatus by the external interface 71*e*. The superordinate apparatus 71 then stores the print job data in the HDD 71*d* using the CPU 71*a*. The superordinate apparatus 71 reads the print job data from the HDD 71*d* using the CPU 71*a*. Furthermore, the superordinate apparatus 71 produces a plurality of raster image data of the each color (Yellow (Y), Cyan (C), Magenta (M), and Black (B)). The superorinate apparatus 71 then stores each color of the raster image data to the RAM 71*c*. At this time, the superordinate apparatus 71 (controlling unit 70) is able to produce each color raster image data by rendering the PDL (Page Description Language) as the RIP processing, which the superordinate apparatus 71 then stores to the RAM 71*c*.

Next, the superordinate apparatus compresses and encodes each color raster image data which is then stored in HDD 71*d* of the superordinate apparatus 71.

When the print controlling apparatus starts the print action, the superordinate apparatus 71 (CPU 71*a*) reads each raster image data from the HDD 71*d*. The superordinate apparatus 71 then decodes each raster image data and stores the result to the RAM 71*c*. The superordinate apparatus 71 next reads each color raster image data from the RAM 71*c* and outputs each color raster image data to the printer control apparatus 72 via each channel of the image data interface 71*g*. The superordinate apparatus 71 is able to output the printing image data to the printer control apparatus 72 via a plurality of data lines 70LD (70LD-Y, 70LD-C, 70LD-M and 70LD-K) shown in FIG. 11 as corresponding to the respective colors.

The superordinate apparatus 71 sends and receives the control information data to/from the printer control apparatus 72 via the control information interface 71*f* (control lines 70LC) based on the progression of the printing action.

Figure 11:
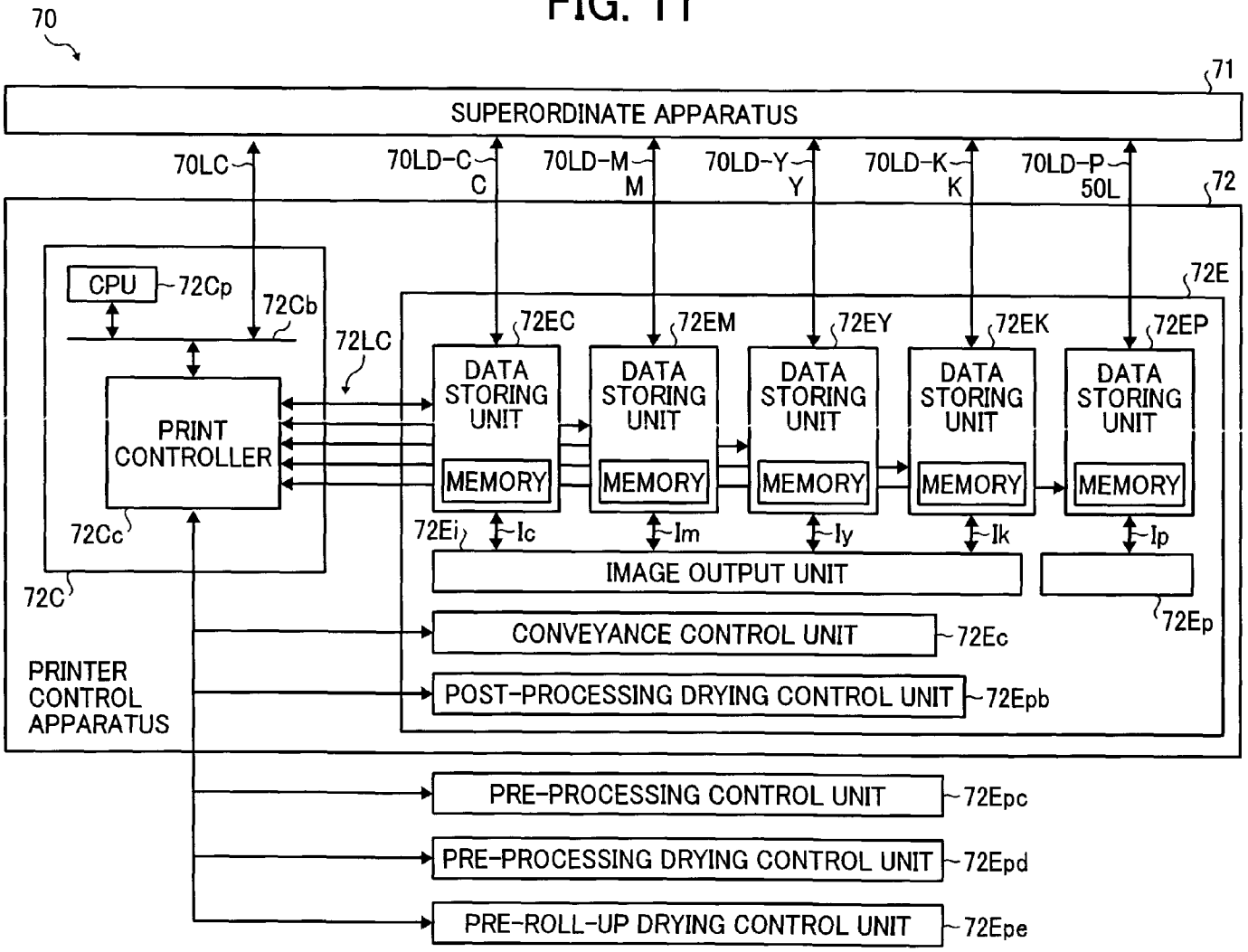
FIG. 11 is a functional block diagram showing of an example of functions of the controlling unit according to one embodiment of the present invention.

Furthermore, when the printer control apparatus starts the post processing, the superordinate apparatus 71, according to this embodiment, reads the encoded post-processing liquid image data from the HDD using the CPU 71*a*. The superordinate apparatus 71 outputs this information to the printer control apparatus 72 via data lines 70LD-P (FIG. 11).

The Printer Control Apparatus

The printer control apparatus 72 of the controlling unit 70 according to an embodiment of present invention controls the action of image forming on the printing medium based on the printing image data and the control information data. The printer control apparatus 72 of this embodiment includes the printer controller 72C and the printer engine 72E.

The printer controller 72C controls the action of the printer engine 72E. The printer controller 72C sends and receives the control information data etc. to/from the superordinate apparatus 71 via the control line 70LC. The printer controller 72C sends and receives the control information data etc. to/from the printer engine 72E via the control line 72LC. This enables the printer controller 72C to write the various printing conditions which are included the control information data to the register of print control unit 72Cc, and store these printing conditions. The printer controller 72C is able to control the printer engine 72E based on the control information data and execute printing based on the print job data (control information data).

As shown in FIG. 11, the printer controller 72C of this embodiment includes a CPU 72Cp and the print control unit 72Cc. The CPU 72Cp and the print control unit 72Cc are connected via a bus 72Cp in the printer controller 72C. The bus 72Cb is connected to the control lines 70LC via a communication interface.

The CPU 72Cp controls the action of the entire printer control apparatus 72 using the control program in ROM. The print control unit 72Cc sends and receives a command or the status information to/from the printer engine 72E based on the control information data which is received from the superordinate apparatus 71. This enables print control unit 72Cc to control the action of the printer engine 72E.

The printer engine 72E controls the action of forming an image on the printing medium based on the printing image data, which is received from the superordinate apparatus 71 and the control information data, which is received from the printer controller 72C. The printer engine 72E controls the action of the post-processing based on the printing image data (post-processing liquid image data), which is received from the superordinate apparatus 71 and the control information data (post-processing control data), which is received from the printer controller 72C.

As shown in FIG. 11, the printer engine 72E is connected to a plurality of data lines 70LD (70LD-Y, 70LD-C, 70LD-M, 70LD-K, and 70LP-P). The printer engine 72E receives the printing image data from the superordinate apparatus 71 via the plurality of data lines (70LD-C) or the like. This enables the printer engine 72E to control the action of image data formation and the performance of the post-processing based on the received printing image data.

The printer engine 72E of this embodiment includes a plurality of data storing units 72EC, 72EM, 72EY, 72EK, and 72EP. The printer engine 72E includes an image output unit 72Ei which receives data from the data storing unit 72C etc., and a conveyance control unit 72Ec which controls the conveyance of the printing medium. Furthermore the printer engine 72E of this embodiment includes a post-processing liquid output unit 72EP which receives the post-processing liquid image data from the data storing unit 72EP, and a post-processing drying control unit 72Epb which controls the drying unit 30 (FIG. 1).

Additionally, the printer engine 72E may include a pre-processing control unit 72Epc, a pre-processing drying control unit 72Epd, and pre-roll-up drying control unit 72Epe.

The configuration of the data storing unit 72EC will be explained with reference to FIG. 12. Additionally, the configuration of the other data storing units 72EM, 72EY, 72EK, and 72EP has been omitted due to the similarity between the configuration of the data storing unit 72EC.

Figure 12:
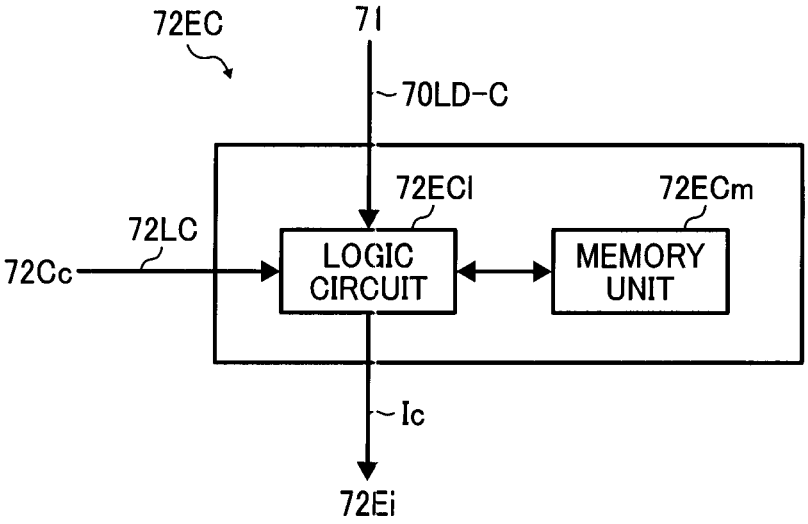
FIG. 12 is a functional block diagram showing of an example of functions of a data management unit in the controlling unit according to one embodiment of the present invention.

As shown in FIG. 12, the data storing unit 72EC includes a logic circuit 72ECl and a memory unit 72ECm. The data storing unit 72EC (the logic circuit 72ECI) is connected to the superordinate apparatus 71 via data line 70LD-C. The data storing unit 72EC (the logic circuit 72ECI) is connected to the printer controller 72C (print control unit 72Cc) via control line 72LC.

The logic circuit 72ECl stores the printing image data to the memory unit 72ECm, which is output from the superordinate apparatus 71, based on the control signal which is output from the printer controller 72C (print control unit 72Cc). Based on the control signal, which is output from the printer controller (print control unit 72Cc), the logic circuit 72ECl reads the printing image data Ic (FIG. 11) from the memory unit 72ECm corresponding to cyan (C), and outputs to the image output unit 72Ei. Additionally, the logic circuit 72ECl (data storing unit 72EP) outputs the post-processing liquid image data Ip (FIG. 11) to the post-processing liquid output unit 72Ep.

The memory unit 72ECm is able to have a capacity which is able to store three pages or more of image data. The three pages of printing image data includes printing image data corresponding to the page which is received from the superordinate apparatus 71, and printing image data corresponding to the page which is sent to the image output unit 72Ei, and printing image data corresponding to the next page to be sent.

Additionally, the data storing unit 72EC may use hardware based logical circuit which is configured by the combination of the plurality of logical circuits. This enables the data storing unit 72EC to perform the process at a higher speed. The data storing unit 72EC may select the process to be performed by logical determination against the control signal of the bit sequence, for example.

The configuration of the image output unit 72Ei will be described with reference to FIG. 13. Additionally, the configuration of the post-processing liquid output unit 72Ep has been omitted due to the similarity to the configuration of the image output unit 72Ei.

Figure 13:
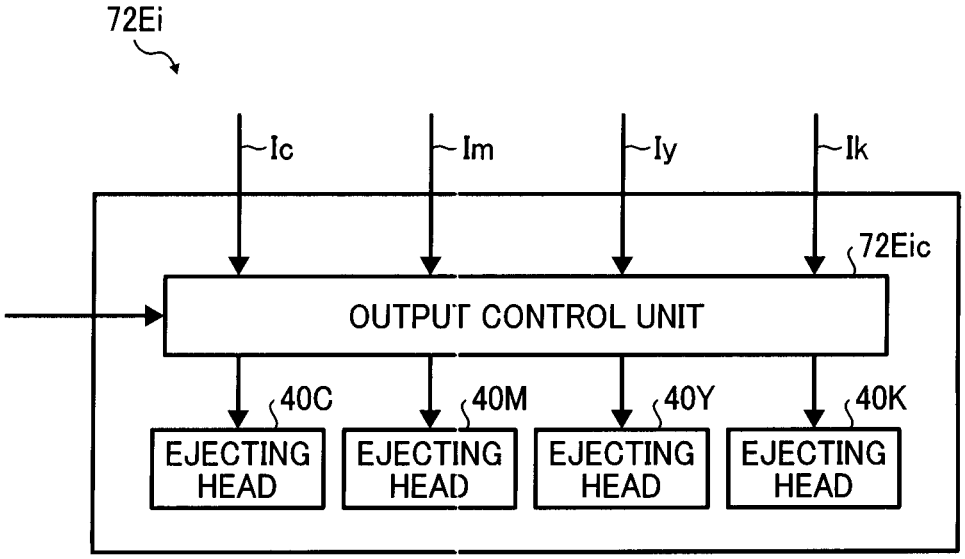
FIG. 13 is a functional block diagram showing of an example of functions of an image output unit in the controlling unit according to one embodiment of the present invention.

As shown in FIG. 13, the image output unit 72Ei includes the output control unit 72Eic. The output control unit 72Eic outputs each printing image data to each ejecting head 40C, 40M, 40Y, and 40K (FIG. 4) corresponding to the color of the printing image data. This enables the output control unit 72Eic to control the action of the ejecting head 40C etc., based on the printing image data.

Specifically, the output control unit 72Eic individually controls the plurality of ejecting heads 40C, 40M, 40Y, and 40K. The output control unit 72Eic may simultaneously control the plurality of ejecting heads 40C, 40M, 40Y, and 40K, based on the printing image data (for example, Ic in FIG. 13). Furthermore, the output control unit 72Eic may control the ejecting head 40C etc. based on the control signal, which is input from a control apparatus. The output control unit 72Eic may control the ejecting head 40C etc. based on an input operation of the user.

Accordingly, the printer control apparatus 72 inputs to the plurality of ejecting heads 40C etc. the printing image data which is output from the superordinate apparatus using the data storing unit 72EC and the output control unit 72Eic. At this time, the printer control apparatus 72 is able to individually control each color printing image data. The printer control apparatus 72 is able to change the configuration of the printer engine 72E corresponding to the number of colors in the printing image data (C, M, Y, and K or K only) or the number of ejecting heads. That is, the printer control apparatus 72 in the image forming apparatus 100 according to this embodiment is able to reduce the cost and downsize the apparatus by mounting only the needed data storing unit 72EC and the needed ejecting head 40C.

For example, when the full-color image is formed by the C, M, Y, and K, the printer control apparatus 72 in the image forming apparatus 100 according to this embodiment has all of the data storing units 72EC etc. This enables the printer control apparatus 72 in the image forming apparatus 100 to connect to ejecting heads 40C, etc. for each output from the data storing units 72EC etc. by the output control unit 72Eic.

For example, when the image is formed by K only, the printer control apparatus 72 in the image forming apparatus 100 may have one data storing unit 72EK and one ejecting head 40K in order to give priority to the cost. This enables the printer control apparatus 72 in the image forming apparatus 100 to connect to the ejecting head 40K for the output from the data storing unit 72EK by the output control unit 72Eic.

Furthermore, for example, when the image is formed by the K only, the printer control apparatus 72 in the image forming apparatus 100 may have one data storing unit 72EK and four ejecting heads in order to give priority to printing speed.

This enables the printer control apparatus 72 in the image forming apparatus 100 to connect the output from the data storing unit 72EK to each of the four ejecting heads by the output control unit 72Eic.

In this case, the printer control apparatus 72 in the image forming apparatus 100 is able to form an image at four times the speed of using only one ejecting head because one color (K) is being formed by four ejecting heads.

Having generally described this invention, further understanding can be obtained by reference to certain specific examples which are provided herein for the purpose of illustration only and are not intended to be limiting.

The First Example

The embodiments of the present invention will be described with reference to image forming apparatus 100E in the first example.

Configurations of the image forming apparatus 100E are shown in FIGS. 1 to 7. The configurations of the image forming apparatus 100E in the foregoing embodiment will be omitted in this example due to the similarities to the configuration of the image forming apparatus 100 shown in FIGS. 1 to 7.

Configurations of a controlling unit 70 of the image forming apparatus 100E are shown in FIGS. 9 to 13. The configurations of the controlling unit of the image forming apparatus 100E in the foregoing embodiment will be omitted in this example due to the similarities to the configuration the controlling unit 70 of image forming apparatus 100 shown in FIGS. 9 to 13. Therefore, the same description is not repeated.

The controlling unit 70 of this example determines the type of the printing medium based on the user input operation to the image forming apparatus 100E.

The operation of forming an image by the image forming apparatus 100E according to this example will be described with reference to FIG. 14.

Figure 14:
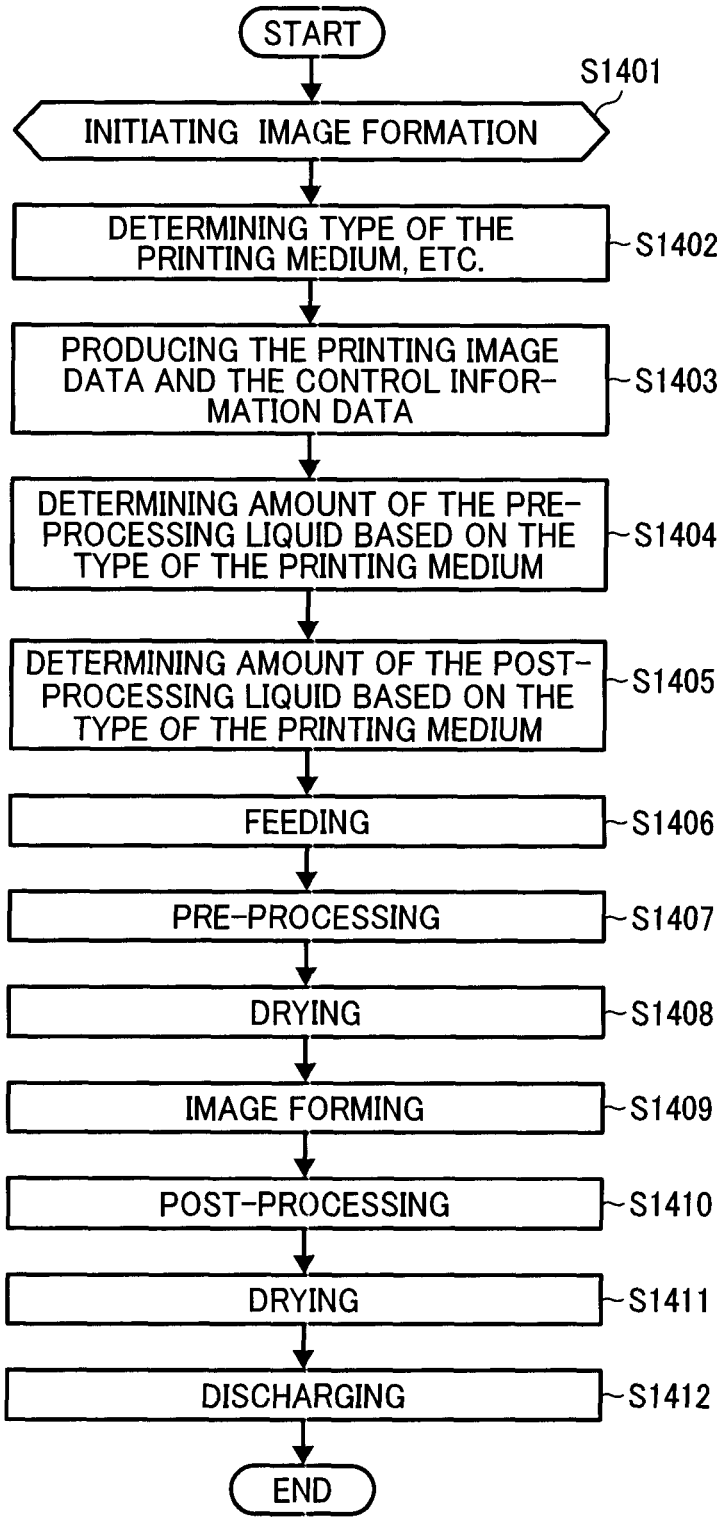
FIG. 14 is a flowchart showing of an exemplary operation by the image forming apparatus according to a first exemplary embodiment of the present invention.

As shown in FIG. 14, the image forming apparatus 100E according to this example, in step S1401, initiates image formation, based on print job data which is input from an external image forming apparatus. The image forming apparatus 100E stores the printing job data, which is input to the HDD 71*d* of the superordinate apparatus 71.

Then, in step S1402, the image forming apparatus 100E determines the type of printing medium using controlling unit 70, and stores (sets) the determined type of printing medium to the HDD 71*d* of the superordinate apparatus 71.

At this time, the controlling unit 70 may further store information of the printing medium (a physical property value of the printing medium such as a material, a thickness, a basis weight of the paper, or the like). The controlling unit 70 may set the type of printing medium based on the type of printing medium pre-stored in the HDD 71*d* of the superordinate apparatus 71. This enables the controlling unit 70 to read the type of printing medium at a later time by using the pre-stored type. Additionally, the image forming apparatus 100E is able to pre-store the type of printing medium to the HDD 71*d* of the superordinate apparatus based on the user input operation.

Then, in step S1403, the image forming apparatus 100E produces the printing image data and the control information data or the like using the superordinate apparatus 71 of the controlling unit 70. Specifically, the superordinate apparatus 71 of the controlling unit 70 produces the print job data and the control information data based on the type of printing medium and the print job data which are stored in the HDD 71*d* or the like.

Next, the image forming apparatus 100E performs step S1404. Additionally, the order of the step of determining the amount of pre-processing liquid (step S1404) and the step of determining the amount of the post-processing liquid (step S1405) may be reversed.

In step S1404, the image forming apparatus 100E calculates the amount of pre-processing liquid (the application amount of the liquid in this example) using the controlling unit 70.

Specifically, the controlling unit 70 calculates the application amount of pre-processing liquid 20L using the pre-processing unit 20, based on type of the printing medium. When a penetrability of the printing medium is high, the controlling unit 70 is able to raise the application amount of the pre-processing liquid 20L. Furthermore, in case that a penetrability of the printing medium is low, the controlling unit 70 is able to reduce the application amount of the pre-processing liquid 20L. Additionally, the image forming apparatus 100E may select the amount of pre-processing liquid 20L based on a user input operation using a UI (User Interface) or the like.

Then, in step S1405, the image forming apparatus 100E calculates the amount of post-processing liquid (the ejected amount of the liquid in this example) using the controlling unit 70. Specifically, as was similarly described above with respect to step S1404, the controlling unit 70 calculates the ejection amount of post-processing liquid 20L (the amount of liquid) using the post-processing unit 50, based on type of the printing medium.

That is, the controlling unit 70 is able to calculate the application amount of the pre-processing liquid 20L based on at least the type of the printing medium, and is also able to calculate the ejection amount of the post-processing liquid 50L based on the type of printing medium. This enables the image forming apparatus 100E to improve the abrasion resistance by raising the ejection amount of the post-processing liquid 50L, when the application amount of the pre-processing liquid has been raised and the abrasion resistance of the formed image is reduced.

Additionally, the controlling unit 70 is able to set the application amount of the pre-processing liquid 20L to 1.5 g/m2 or more, when raising the application amount of the pre-processing liquid 20L. The controlling unit 70 is able to set the application amount of the post-processing liquid 50L to 1.2 g/m2 or more, when raising the application amount of the post-processing liquid 50L. Alternatively, the controlling unit 70 is able to set the application amount of the pre-processing liquid 20L to less than 1.5 g/m2, when reducing the application amount of the pre-processing liquid 20L. The controlling unit 70 is able to set the application amount of the post-processing liquid 50L to less than 1.2 g/m2, when reducing the application amount of the post-processing liquid 50L. The controlling unit 70 does not need to perform any application or ejection, when the application amount of the pre-processing 20L and the ejection amount of the post-processing liquid 50L is reduced. Furthermore, the controlling unit 70 may change the application amount of the pre-processing liquid 20L and the ejection amount of the post-processing liquid 50L, based on the physical property value of the printing medium or the like.

In step S1406, the image forming apparatus 100E feeds the printing medium to the pre-processing unit 20 using the sheet feeding unit 10 (FIG. 1). Additionally, the image forming apparatus 100E may initiate step S1406 soon after the initiation of step S1401. The image forming apparatus 100E performs step S1408 after initiating the sheet feeding.

In step S1407, the image forming apparatus 100E performs the pre-processing using the pre-processing unit 20 (FIG. 1). Specifically, the pre-processing unit 20 controls the nip pressure based on the determined application amount of the pre-processing liquid 20L which is calculated in step S1404 using the pressure controller 25. In addition the application amount of the pre-processing liquid 20L (the thickness of the liquid film etc.) is also controlled (changed) based on the calculation in step S1404. Additionally, the pre-processing unit 20 may control the application amount of the pre-processing liquid 20L by changing the rotation speed of the applying roller 23 (FIG. 2).

Figure 15:
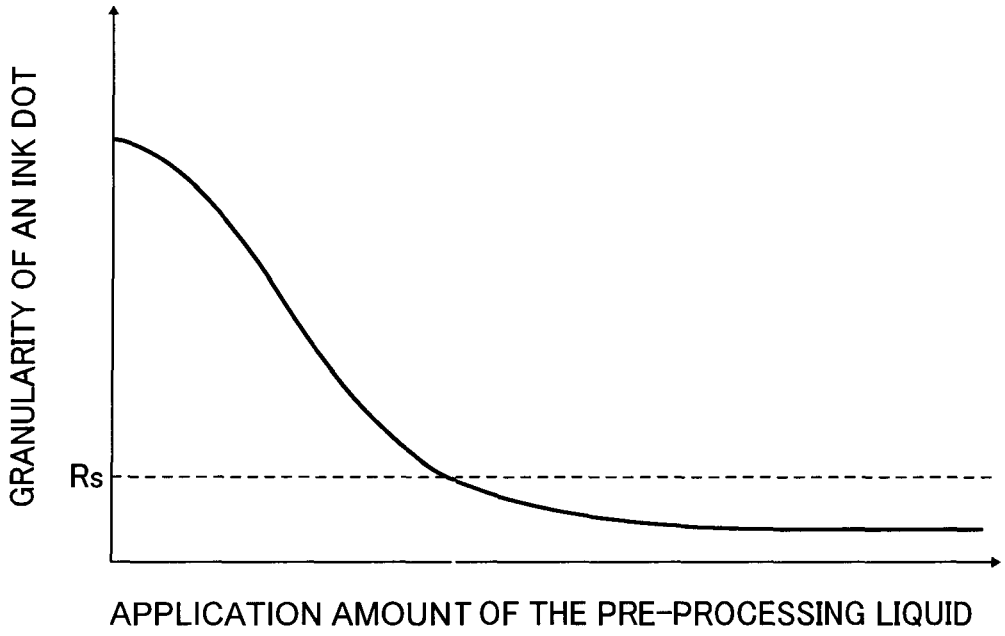
FIG. 15 is an illustration showing of the relationship between a granularity of an image and a coating amount of pre-processing liquid according to the first exemplary embodiment of the present invention.

This enables the image forming apparatus 100E to reduce bleeding of the formed image by controlling the application amount of the pre-processing liquid 20L. As shown in FIG. 15, the image forming apparatus 100E is able to make the granularity of the ink dots to be small by raising the application amount of the pre-processing liquid 20L. That is, in the image forming apparatus 100E, the granularity of the ink dots may be set to be less than a predetermined granularity Rs, by raising the application amount of the pre-processing liquid 20L.

The predetermined granularity Rs may be the granularity at which it is difficult for the ink to bleed on the printing medium. The predetermined granularity Rs may be determined by experiment or by numerical calculations. The image forming apparatus 100E then feeds the printing medium to the drying unit 30 (the pre-processing liquid drying unit 31 in FIG. 1).

In step S1408, the image forming apparatus 100E dries the printing medium using the pre-processing liquid drying unit 31 (FIG. 1). The pre-processing liquid drying unit 31 controls drying strength (pre-processing liquid dry strength) based on the type of printing medium. Furthermore, the pre-processing liquid drying unit 31 is able to further control the drying strength (pre-processing liquid dry strength) using the application amount the pre-processing liquid 20L.

Then, the image forming apparatus 100E feeds the printing medium to the image forming unit 40 (FIGS. 1, 4, 5).

In step S1409, as the image formation step, the image forming apparatus 100E forms an image on a surface of the printing medium using the image forming unit 40. The image is formed based on the printing image data which was produced (in step S1403). The image forming unit 40 may further form the image taking into account the type of the printing medium. The image forming unit 40 is able to control the action of the image forming by controlling the voltage applied to the piezoelectric element 45P (the pressure generating device 45 in FIGS. 6, 7)

The image forming apparatus 100E then feeds the printing medium to the post-processing unit 50 (FIG. 1).

In step S1410, as the post-processing step, the image forming apparatus 100E treats the printing medium using the post-processing unit 50.

Specifically, the post-processing unit 50 ejects (deposits) the post-processing liquid 50L onto a specified area in the image formation area of the printing medium, based on the post-processing liquid image data (in step S1403) and the ejection amount of the post-processing liquid, which was calculated (in step S1404). The post-processing unit 50 is able to control the ejection amount of the post-processing liquid 50L on the printing medium using the post-processing liquid output unit 72Ep of the controlling unit 70, based on the post-processing liquid image data.

The image forming apparatus 100E then feeds the printing medium to the drying unit 30 (the post-processing liquid drying unit 32 in FIG. 1).

In step S1411, the image forming apparatus 100E dries the printing medium using the post-processing liquid drying unit 32 (heat roller). The post-processing liquid drying unit 32 is able to control the drying strength (post-processing liquid dry strength) based on the type of the printing medium. Furthermore, the post-processing liquid drying unit 32 is able to control the drying strength (post-processing liquid dry strength) further using the application amount of the pre-processing liquid and/or the ejection amount of the post-processing liquid.

In step S1412, the image forming apparatus 100E discharges the printing medium using the sheet discharging unit 60 (FIG. 1).

Finally, in the END step, the image forming apparatus 100E completes the image forming operation.

The image forming apparatus 100E according to this example is able to obtain the same effect as the image forming apparatus 100 in the embodiments described above.

The Second Example

The embodiments of the present invention will be described with reference to image forming apparatus 200E in the second example.

Configurations of the image forming apparatus 200E are shown in FIGS. 1 to 7. The configurations of the image forming apparatus 200E in the foregoing embodiment will be omitted in this example due to the similarities to the configuration of the image forming apparatus 100 shown in FIGS. 1 to 7 and the image forming apparatus 100E of the first example.

Configurations of a controlling unit 70 of the image forming apparatus 200E are shown in FIGS. 9 to 13. The configurations of the controlling unit of the image forming apparatus 200E in the foregoing embodiment will be omitted in this example due to the similarities to the configuration the controlling unit 70 of image forming apparatus 100 shown in FIGS. 9 to 13 and the image forming apparatus 100E of the first example. Therefore, the same description is not repeated.

In the first example, the controlling unit 70 calculates the ejection amount of post-processing liquid based on the type of printing medium.

The controlling unit 70 according to this example calculates the ejection amount of the post-processing liquid based on the amount of the pre-processing liquid.

That is, in this example, the controlling unit 70 calculates the ejection amount of the post-processing liquid using the amount of pre-processing liquid, which is calculated based on user input information input to the image forming apparatus 200E by a user.

The input information may include the type of printing medium. Furthermore, the input information may include penetrability and glossiness of the printing medium.

The operation of forming an image by the image forming apparatus 200E according to this example will be described with reference to FIG. 16.

Figure 16:
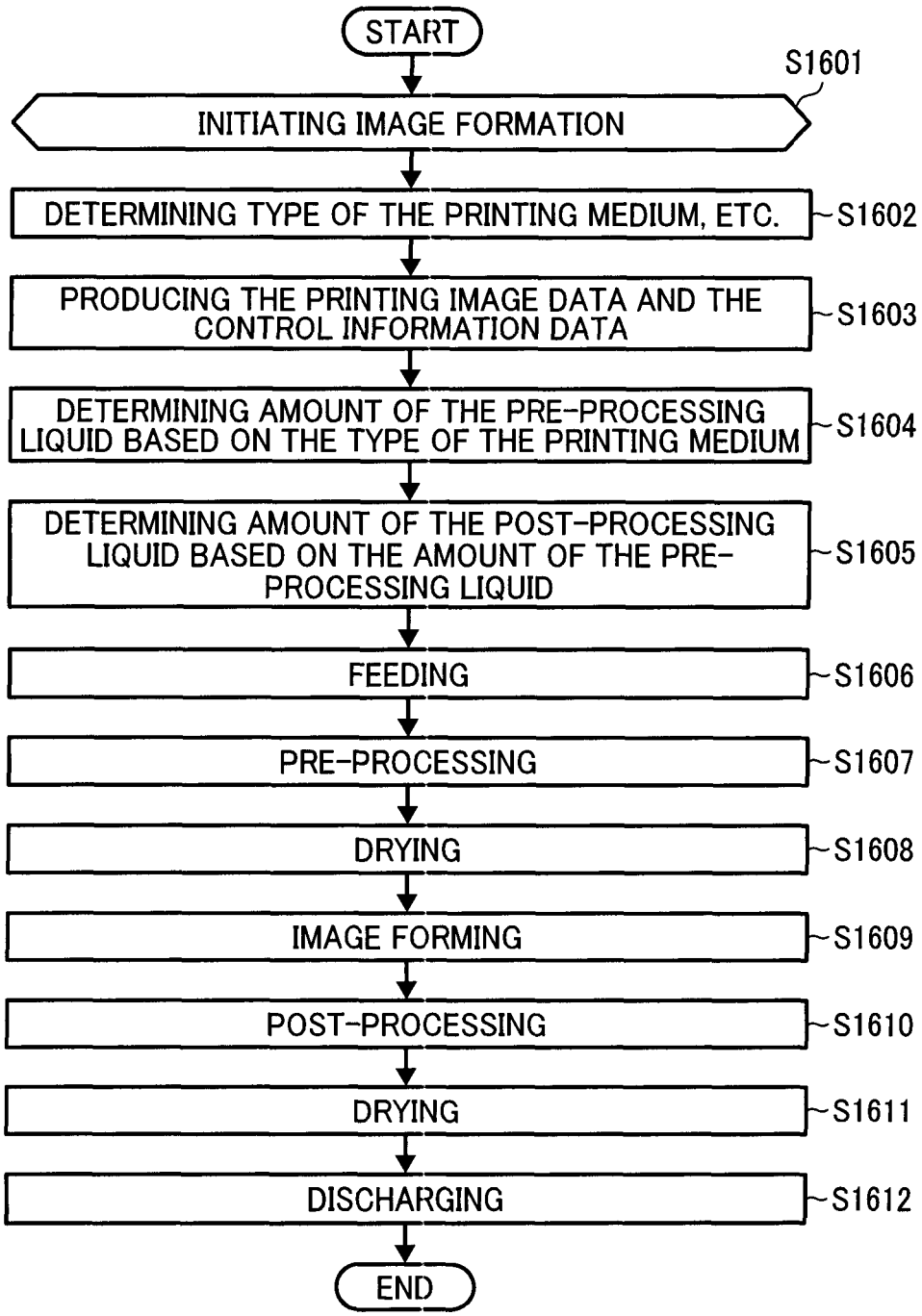
FIG. 16 is a flowchart showing an exemplary operation by the image forming apparatus according to a second exemplary embodiment of the present invention.

As shown in FIG. 16, the image forming apparatus 200E performs steps S1601 to S1604 similarly to steps S1401 to S1404 performed by the image forming apparatus 100E of the first example.

In step S1605, the image forming apparatus 200E calculates the amount of post-processing liquid (ejection amount of the post processing liquid) using the controlling unit 70. The controlling unit 70 of this example calculates the amount of post-processing liquid based on the amount of pre-processing liquid which is calculated in step S1604. That is, the controlling unit 70 (the image forming apparatus 200E) calculates the application amount of pre-processing liquid based on the type of printing medium, and calculates the ejection amount of post-processing liquid based on the application amount of the pre-processing liquid. Accordingly, the image forming apparatus 200E according to this example calculates the amount of post-processing liquid based on the type of printing medium. This is the case because the amount of the pre-processing liquid is calculated based on the type of printing medium.

After calculating the amount of post-processing liquid, the image forming apparatus 200E performs steps S1606 to S1612 similarly to steps S1406 to S1412 performed by the image forming apparatus 100E of the first example. Then, in END step, the image forming apparatus 200E completes the image forming operation.

Accordingly, the image forming apparatus 200E according to the second example is able to obtain the same effect as the image forming apparatus 100 of the above noted embodiments and the image forming apparatus 100E of the first example.

The Third Example

The embodiments of the present invention will be described with reference to image forming apparatus 300E in the third example.

Configurations of the image forming apparatus 300E are shown in FIGS. 1 to 7. The configurations of the image forming apparatus 300E in the foregoing embodiment will be omitted in this example due to the similarities to the configurations of the image forming apparatus 100 shown in FIGS. 1 to 7, the image forming apparatus 100E of the first example, and the image forming apparatus 200E of the second example.

Configurations of a controlling unit 70 of the image forming apparatus 300E are shown in FIGS. 9 to 13. The configurations of the controlling unit of the image forming apparatus 300E in the foregoing embodiment will be omitted in this example due to the similarities to the configurations the controlling unit 70 of the image forming apparatus 100 shown in FIGS. 9 to 13, the image forming apparatus 100E of the first example, and the image forming apparatus 200E of the second example. Therefore, the same description is not repeated.

In the second example, the controlling unit calculates the amount of pre-processing liquid (application amount) based on the type of printing medium, and calculates the amount of post-processing liquid based on the calculated amount of pre-processing liquid.

The controlling unit 70 according to this example calculates the application amount of pre-processing liquid based on the type of printing medium, and calculates the amount of post-processing liquid based on the calculated amount of the pre-processing liquid. The controlling unit 70 further adjusts (re-calculates) the amount of post-processing liquid based on the type of printing medium. For example, the controlling unit 70 determines the glossiness of the printing medium based on the type of printing medium, and adjusts (re-calculates) the ejection amount of the post-processing liquid based on the glossiness.

The operation of image formation by the image forming apparatus 300E according to this example will be described with reference to FIG. 17.

Figure 17:
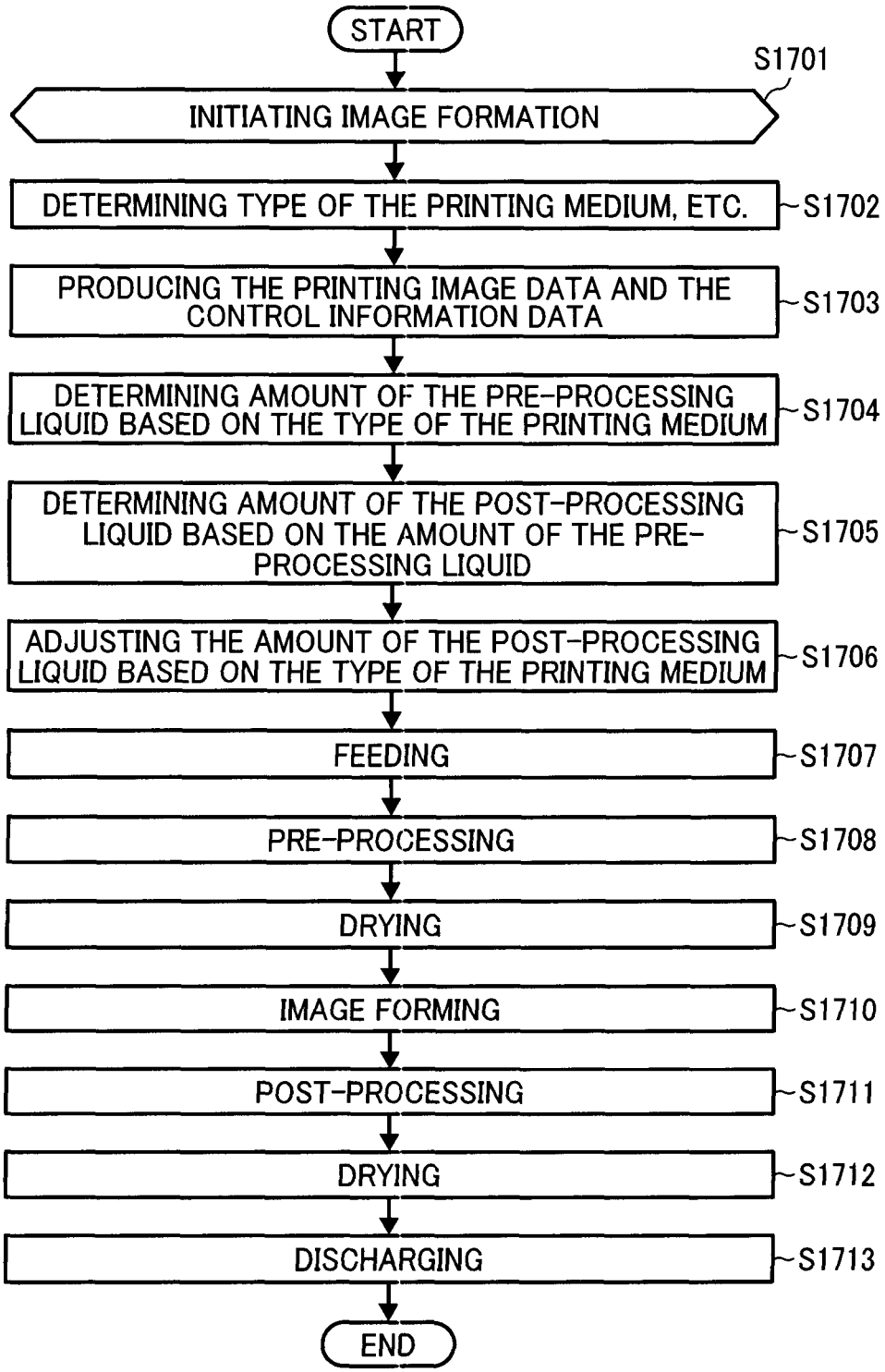
FIG. 17 is a flowchart showing an exemplary operation by the image forming apparatus according to a third exemplary embodiment of the present invention.

As shown in FIG. 17, the image forming apparatus 300E performs steps S1701 to S1705 similarly to steps S1601 to step S1605 performed by the image forming apparatus 200E of the second example.

Then, in step S1706, the image forming apparatus 300E adjusts (re-calculates) the amount of post-processing liquid (the ejection amount) using the controlling unit 70. The controlling unit 70 of this example re-calculates the ejection amount of post-processing liquid based on user input information input to the image forming apparatus 300E by a user.

Specifically, the superordinate apparatus 71 of the controlling unit 70 first reads a type of printing medium from the HDD 71*d* or the like. Next, the controlling unit 70 re-calculates the ejection amount of post-processing liquid 50L based on the type of printing medium and the ejection amount of post-processing liquid, which was calculated in step S1705.

Accordingly, the amount of the pre-processing liquid may be small based on the type of printing medium. For example, when the printing medium has high glossiness, and when there is great difference in glossiness between the area on which image is formed and the area on which image is not formed, the image forming apparatus 300E is able to raise the application amount of the post-processing liquid based on the type of printing medium. That is, the image forming apparatus 300E is able to reduce the cost of pre-processing liquid 20L and reduce the difference in glossiness between the area on which image is formed and the area on which image is not formed by raising the ejection amount of post-processing liquid 50L. Accordingly, the image forming apparatus 300E is able to reduce the cost of the pre-processing liquid and improve the quality of the image.

After adjusting the amount of the post-processing liquid, the image forming apparatus 300E performs steps S1707 to S1713 similarly steps S1606 to S1612 performed by the image forming apparatus 200E of the second example. Then, in END step, the image forming apparatus 200E completes the image forming operation.

Accordingly, the image forming apparatus 300E according to the third example is able to obtain the same effect as the image forming apparatus 100 of the above described embodiment, the image forming apparatus 100E of the first example, and the image forming apparatus 200E of the second example.

The Fourth Example

The embodiments of the present invention will be described with reference to image forming apparatus 400E in the fourth example.

Configurations of the image forming apparatus 400E are shown in FIGS. 1 to 7. The configurations of the image forming apparatus 400E in the foregoing embodiment will be omitted in this example due to the similarities to the configurations of the image forming apparatus 100E of the first example.

Configurations of a controlling unit 70 of the image forming apparatus 400E are shown in FIGS. 9 to 13. The configurations of the controlling unit of the image forming apparatus 400E in the foregoing embodiment will be omitted in this example due to the similarities to the configurations the controlling unit 70 of the image forming apparatus 100E of the first example. Therefore, the same description is not repeated.

The flowchart of the first example (FIG. 14) does not include a step of determining drying strength (pre-processing liquid drying strength and post-processing liquid drying strength). The controlling unit 70 according to this example includes the step of determining the drying strength (pre-processing liquid drying strength and post-processing liquid drying strength) based on type of the printing medium. The step of determining the pre-processing liquid drying strength and post-processing liquid drying strength will be described as follows.

The operation of image formation by the image forming apparatus 400E according to this example will be described with reference to FIG. 18.

Figure 18:
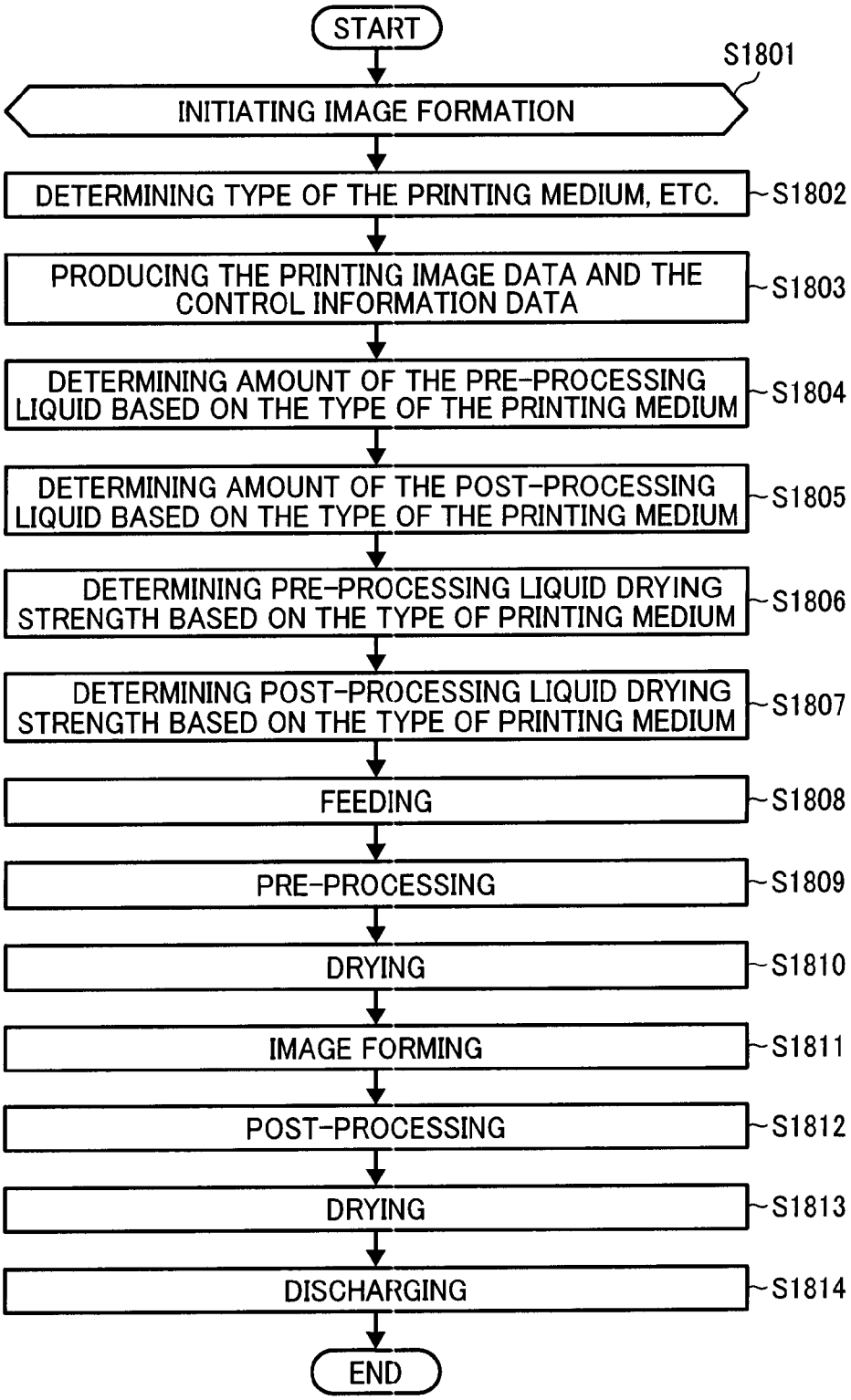
FIG. 18 is a flowchart showing an exemplary operation by the image forming apparatus according to a fourth exemplary embodiment of the present invention.

As shown in FIG. 18, the image forming apparatus 400E performs steps S1801 to S1805 similarly to steps S1401 to S1405 performed by the image forming apparatus 100E of the first example.

In step S1806, the image forming apparatus 400E determines the pre-processing liquid drying strength for the pre-processing liquid drying unit 31 (FIG. 1) using the controlling unit 70. In this example, the controlling unit 70 determines the pre-processing liquid drying strength based on user input information (type of the printing medium) input to the image forming apparatus 400E by a user.

In step S1807, the image forming apparatus 400E determines the post-processing liquid drying strength of the post-processing liquid drying unit 32 (FIG. 1) using the controlling unit 70. In this example, the controlling unit 70 determines the post-processing liquid drying strength based on user input information (type of the printing medium) input to the image forming apparatus 400E by a user.

The image forming apparatus 400E performs steps S1808 to S1814 similarly to steps S1406 to S1412 performed by the image forming apparatus 100E of the first example. Then, in the END step, the image forming apparatus 200E completes the image forming operation. Additionally, the method of controlling the drying strength in steps S1810 and S1813 has been omitted due to similarities to the image forming apparatus 100 (FIG. 3) according to the above embodiment.

Accordingly, the image forming apparatus 400E according to the fourth example is able to obtain the same effect as the image forming apparatus 100E of the first example.

The Fifth Example

The embodiments of the present invention will be described with reference to image forming apparatus 500E of the fifth example.

Configurations of the image forming apparatus 500E are shown in FIGS. 1 to 7. The configurations of the image forming apparatus 500E in the foregoing embodiment will be omitted in this example due to the similarities to the configuration of the image forming apparatus 200E of the second example.

Configurations of a controlling unit 70 of the image forming apparatus 500E are shown in FIGS. 9 to 13. The configurations of the controlling unit of the image forming apparatus 500E in the foregoing embodiment will be omitted in this example due to the similarities to the configurations the controlling unit 70 of the image forming apparatus 200E of the second example. Therefore, the same description is not repeated.

The flowchart of the second example (FIG. 16) does not include a step of determining a drying strength (pre-processing liquid drying strength and post-processing liquid drying strength). The controlling unit 70 according to this example includes the step of determining the drying strength (pre-processing liquid drying strength and post-processing liquid drying strength) based on the amount of pre-processing liquid and the amount of post-processing liquid. The step of determining the pre-processing liquid drying strength and post-processing liquid drying strength will be described as follows.

The operation of image formation by the image forming apparatus 500E according to this example will be described with reference to FIG. 19.

Figure 19:
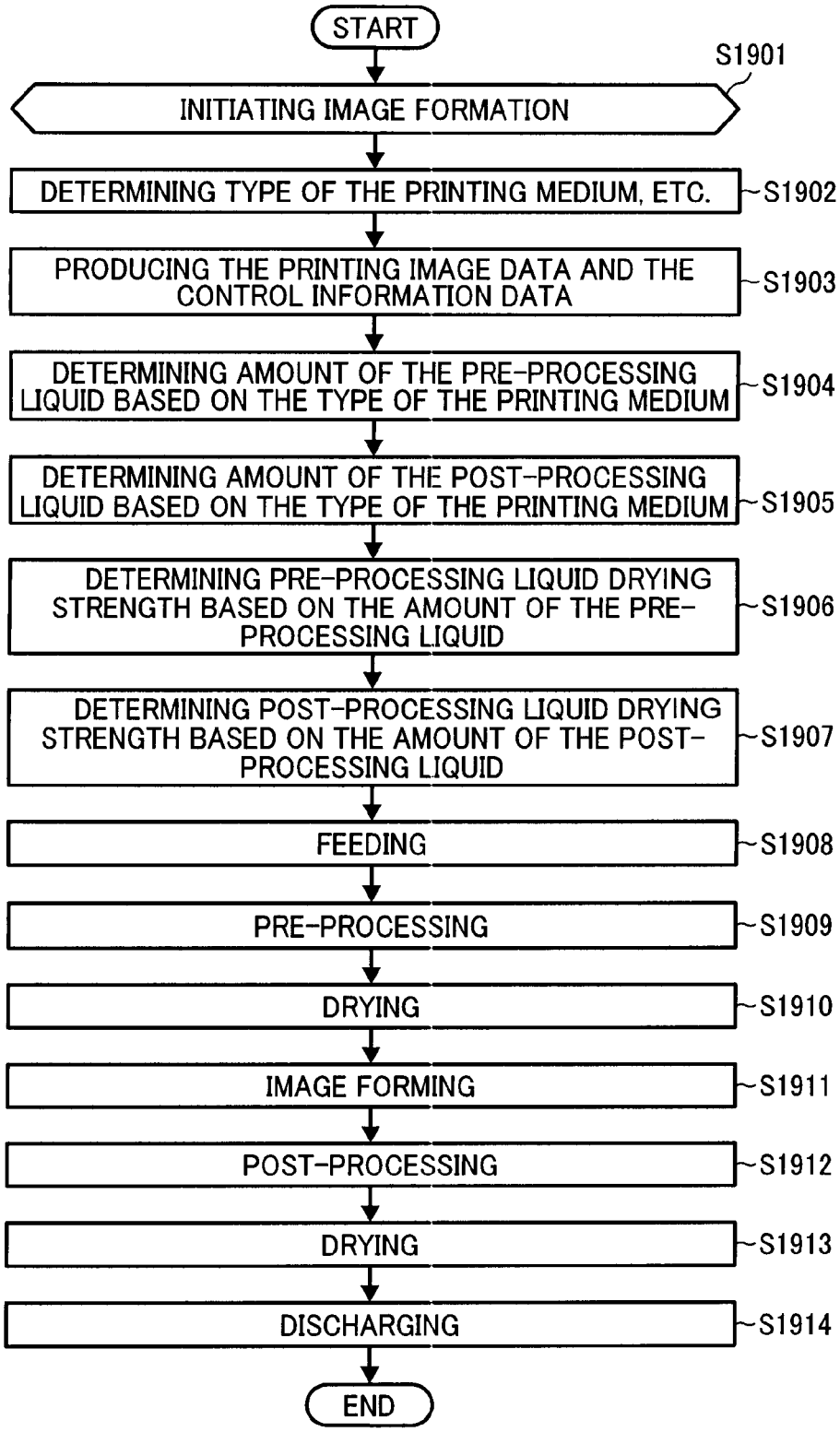
FIG. 19 is a flowchart showing an exemplary operation by the image forming apparatus according to a fifth exemplary embodiment of the present invention.

As shown in FIG. 19, the image forming apparatus 500E performs steps S1901 to S1905 similarly to steps S1601 to S1605 performed by the image forming apparatus 200E of the second example.

In step S1906, the image forming apparatus 500E determines the pre-processing liquid drying strength of the pre-processing liquid drying unit 31 (FIG. 1) using the controlling unit 70. In this example, the controlling unit 70 determines the pre-processing liquid drying strength based on the amount of pre-processing liquid (the application amount) which was calculated in step S1904.

In step S1907, the image forming apparatus 500E determines the post-processing liquid drying strength for the post-processing liquid drying unit 32 (FIG. 1) using the controlling unit 70. In this example, the controlling unit 70 determines the post-processing liquid drying strength based on the amount of post-processing liquid (the application amount) which was calculated in step S1905.

The image forming apparatus 500E performs steps S1908 to S1914 similarly to steps S1606 to S1612 performed by the image forming apparatus 200E of the second example. Then, in the END step, the image forming apparatus 500E completes the image forming operation. Additionally, the method of controlling the drying strength in steps S1911 and S1914 has been omitted due to the similarity to the image forming apparatus 100 (FIG. 3) according to the above embodiment.

Accordingly, the image forming apparatus 500E according to the fifth example is able to obtain the same effect as the image forming apparatus 200E of the second example.

The Sixth Example

The embodiments of the present invention will be described with reference to image forming apparatus 600E of the sixth example.

Configurations of the image forming apparatus 600E are shown in FIGS. 1 to 7. The configurations of the image forming apparatus 600E in the foregoing embodiment will be omitted in this example due to the similarities to the configuration of the image forming apparatus 300E of the third example.

Configurations of a controlling unit 70 of the image forming apparatus 600E are shown in FIGS. 9 to 13. The configurations of the controlling unit of the image forming apparatus 600E in the foregoing embodiment will be omitted in this example due to the similarities to the configurations the controlling unit 70 of the image forming apparatus 300E of the third example. Therefore, the same description is not repeated.

The flowchart of the third example (FIG. 17) does not include a step of determining the drying strength (pre-processing liquid drying strength and post-processing liquid drying strength). The controlling unit 70 according to this example includes the step of determining the drying strength (pre-processing liquid drying strength and post-processing liquid drying strength) based on the amount of pre-processing liquid and the amount of post-processing liquid. The step of determining the pre-processing liquid drying strength and post-processing liquid drying strength will be described as the follows.

The operation of image formation by the image forming apparatus 600E according to this example will be described with reference to FIG. 20.

Figure 20:
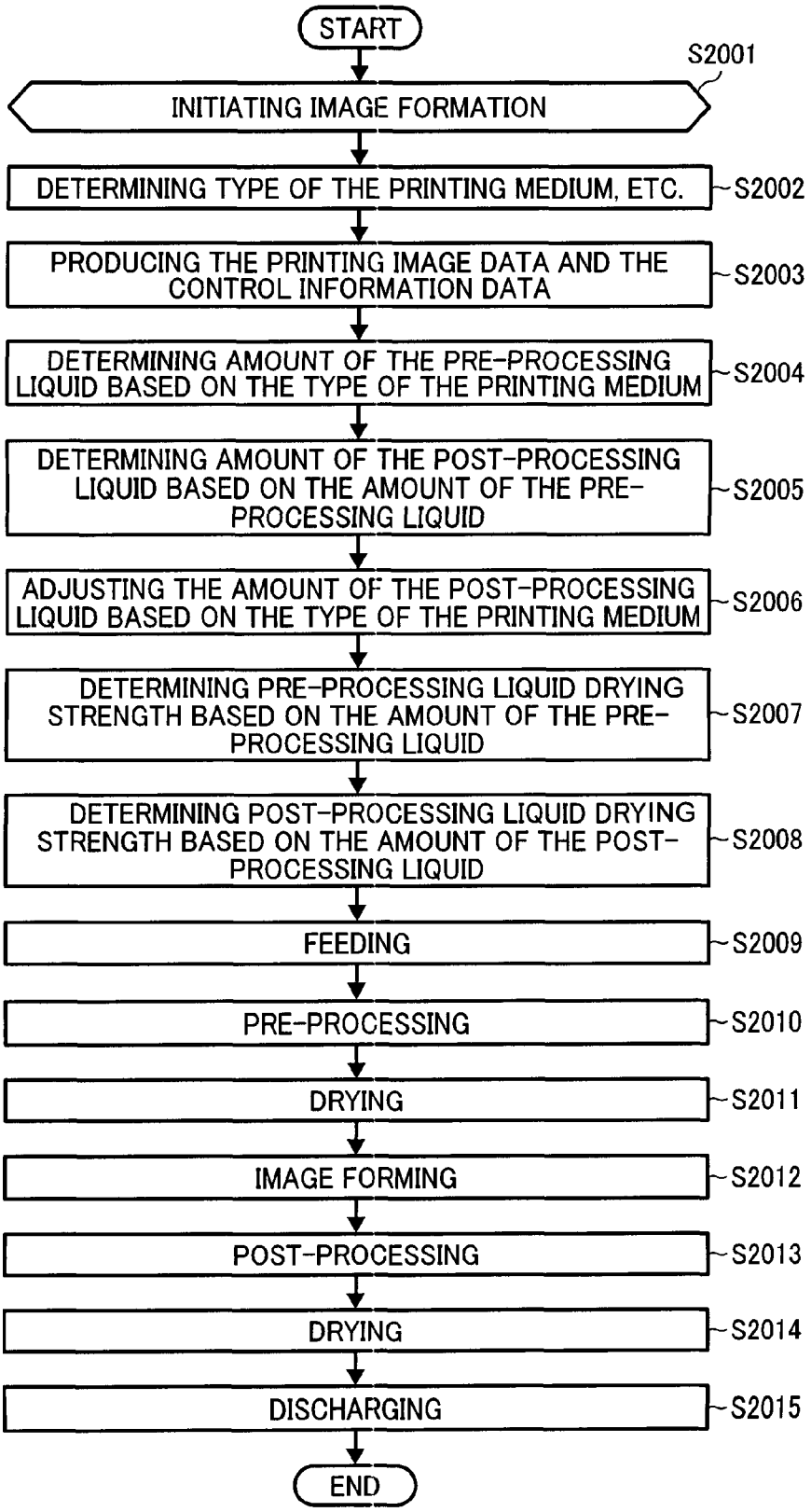
FIG. 20 is a flowchart showing an exemplary operation by the image forming apparatus according to a sixth exemplary embodiment of the present invention.

As shown in FIG. 20, the image forming apparatus 600E performs steps S2001 to S2006 similarly to steps S1701 to S1706 performed by the image forming apparatus 300E of the third example.

In step S2007, the image forming apparatus 600E determines the pre-processing liquid drying strength for the pre-processing liquid drying unit 31 (FIG. 1) using the controlling unit 70. In this example, the controlling unit 70 determines the pre-processing liquid drying strength based on the amount of pre-processing liquid (the application amount) which was calculated in step S2004.

In step S2008, the image forming apparatus 600E determines the post-processing liquid drying strength for the post-processing liquid drying unit 32 (FIG. 1) by the controlling unit 70. In this example, the controlling unit 70 determines the post-processing liquid drying strength based on the amount of post-processing liquid (the application amount) which was calculated in step S2006.

The image forming apparatus 600E performs steps S2009 to S2015 similarly to steps S1707 to S1713 performed by the image forming apparatus 300E of the third example. Then, in the END step, the image forming apparatus 600E completes the image forming operation. Additionally, the method of controlling the drying strength in steps S2011 and S2014 has been omitted due to the similarities to the image forming apparatus 100 (FIG. 3) according to the above embodiment.

Accordingly, the image forming apparatus 600E according to the sixth example is able to obtain the same effect as the image forming apparatus 300E in the third example.

The foregoing description of the embodiments of the invention has been presented for the purpose of illustration and is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

What is claimed is:

1. An image forming apparatus comprising:

an image forming unit configured to eject droplets from the image forming apparatus, and to form an image on a surface of a printing medium;

a pre-processing unit configured to apply a pre-processing liquid to the surface of the printing medium before the image is formed by the image forming unit; and a post-processing unit configured to apply a post-processing liquid different from the pre-processing liquid to the surface of the printing medium after the image is formed by the image forming unit, wherein the pre-processing unit applies an amount of the pre-processing liquid which is determined based on a type of the printing medium and the post-processing unit applies an amount of the post-processing liquid which is determined based on the type of the printing medium, wherein the application amount of the post-processing liquid is reduced when the application amount of the pre-processing liquid is reduced, and wherein the application amount of the post-processing liquid is raised when the application amount of the pre-processing liquid is raised.

2. The image forming apparatus according to claim 1, wherein the post-processing unit is further configured to apply the post-processing liquid to a smaller area than a surface area on which the image is formed.

3. The image forming apparatus according to claim 1, wherein the post-processing unit is further configured to apply the post-processing liquid to a smaller area than a surface area on which the pre-processing liquid is applied.

4. The image forming apparatus according to claim 1, wherein the application amount of the post-processing liquid is further determined based on a glossiness of the printing medium.

5. An image forming method comprising:

applying pre-processing liquid to a surface of a printing medium;

forming an image on the surface of the printing medium on which the pre-processing liquid was applied; and applying post-processing liquid different from the pre-processing liquid to the surface of the printing medium on which the image is formed, wherein the pre-processing liquid is applied in an amount which is determined based on a type of the printing medium and the post-processing liquid is applied in an amount which is determined based on the type of the printing medium, wherein the application amount of the post-processing liquid is reduced when the application amount of the pre-processing liquid is reduced, and the application amount of the post-processing liquid is raised when the application amount of the pre-processing liquid is raised.

6. The image forming method according to claim 5, wherein the post-processing liquid is applied in shape of dots or stripes to the surface of the printing medium on which the image is formed or on which the pre-processing liquid is applied.

7. The image forming method according to claim 5, wherein the application amount of the post-processing liquid is raised when the glossiness of the formed image is raised.

* * * * *